US011351411B2

(12) United States Patent
Barbour

(10) Patent No.: US 11,351,411 B2
(45) Date of Patent: Jun. 7, 2022

(54) SYSTEM AND METHOD FOR POLE BIKING

(71) Applicant: Timothy Barbour, Irving, TX (US)

(72) Inventor: Timothy Barbour, Irving, TX (US)

( * ) Notice: Subject to any disclaimer, the term of this patent is extended or adjusted under 35 U.S.C. 154(b) by 0 days.

(21) Appl. No.: 17/482,627

(22) Filed: Sep. 23, 2021

(65) Prior Publication Data

US 2022/0088434 A1 Mar. 24, 2022

Related U.S. Application Data

(60) Provisional application No. 63/083,014, filed on Sep. 24, 2020.

(51) Int. Cl.
*A63B 22/00* (2006.01)
*A63B 69/16* (2006.01)
*A63B 22/06* (2006.01)

(52) U.S. Cl.
CPC ..... *A63B 22/001* (2013.01); *A63B 22/0605* (2013.01); *A63B 69/16* (2013.01)

(58) Field of Classification Search
CPC .... A63B 22/06–0664; A63B 69/16–18; A63B 69/18–187
See application file for complete search history.

(56) References Cited

U.S. PATENT DOCUMENTS 3,758,111 A * 9/1973 Agamian ..... A63B 22/0023 482/57
4,451,033 A * 5/1984 Nestegard ..... A63B 22/0605 482/62
4,741,527 A * 5/1988 Nestegard ..... A63B 22/001 482/62
4,880,225 A * 11/1989 Lucas ..... A63B 22/001 482/59
5,005,825 A * 4/1991 Fogel ..... A63B 22/0046 280/294

(Continued)

FOREIGN PATENT DOCUMENTS

DE 102007006712 A1 10/2008
DE 202009010829 U1 11/2009
WO WO-2008151338 A2 * 12/2008 ..... A63B 23/03575

OTHER PUBLICATIONS

WO2008/151338A2 Machine Translation (Year: 2022).*

*Primary Examiner* — Nyca T Nguyen
(74) *Attorney, Agent, or Firm* — Houda El-Jarrah; Bold IP, PLLC

(57) ABSTRACT

A stationary bicycle is described having walking pole attachments for a pair of walking poles. The walking pole attachments are mechanisms that are attachable and mountable to one or more parts of a handlebar of a stationary bicycle in order to store the walking poles on the stationary bicycle. The walking poles can be mounted and stored vertically on either side of the handlebar of the stationary bicycle or can be mounted and stored horizontally on top of the handlebar of the stationary bicycle so as to be easily accessible to the user of the stationary bicycle while the user is seated on the stationary bicycle and is pedaling. Further, exercises are described that highlight various manners of exercising on the stationary bicycle while using the walking poles in a new form of exercise called pole-biking. Further, attachment mechanisms are attachable to the stationary bicycle for a resistance band.

18 Claims, 16 Drawing Sheets

(56) References Cited

U.S. PATENT DOCUMENTS

| | | | | | |
|---|---|---|---|---|---|
| 5,098,087 | A * | 3/1992 | Matile | A61G 5/025 | 280/210 |
| 5,199,933 | A * | 4/1993 | Illuzzi | A63B 23/0476 | 482/62 |
| 5,290,212 | A * | 3/1994 | Metcalf | A63B 21/0088 | 482/111 |
| 5,803,874 | A * | 9/1998 | Wilkinson | A63B 22/0012 | 482/51 |
| 6,007,462 | A * | 12/1999 | Chen | A63B 22/001 | 482/51 |
| 6,159,132 | A * | 12/2000 | Chang | A63B 21/225 | 482/57 |
| 6,508,746 | B1 * | 1/2003 | Jacobs | A63B 21/023 | 482/51 |
| 6,893,382 | B1 * | 5/2005 | Moon | A63B 21/154 | 482/51 |
| 8,113,996 | B1 * | 2/2012 | Allen | A63B 22/0605 | 482/57 |
| 8,241,187 | B2 * | 8/2012 | Moon | A63B 22/203 | 482/54 |
| 9,474,925 | B1 * | 10/2016 | Hsiung | A63B 21/225 | |
| 10,155,132 | B2 * | 12/2018 | Jones | A63B 1/00 | |
| 10,232,211 | B1 * | 3/2019 | Koch | A63B 23/03591 | |
| 2004/0043873 | A1 | 3/2004 | Wilkinson et al. | | |
| 2004/0066016 | A1 * | 4/2004 | Raikin | B62M 29/00 | 280/219 |
| 2007/0191197 | A1 * | 8/2007 | Vittone | A63B 21/04 | 482/121 |
| 2009/0054209 | A1 * | 2/2009 | Takeishi | A63B 69/0028 | 482/8 |
| 2009/0170671 | A1 * | 7/2009 | Faktenmark | A63B 69/0028 | 482/122 |
| 2016/0280319 | A1 * | 9/2016 | Dodds | B62M 29/02 | |
| 2019/0224525 | A1 * | 7/2019 | Romero | A63B 21/0628 | |

* cited by examiner

SYSTEM AND METHOD FOR POLE BIKING

CROSS-REFERENCE TO RELATED APPLICATIONS

This application is a non-provisional application which claims priority to U.S. Provisional Patent Application No. 63/083,014, which was filed on Sep. 24, 2020, which is incorporated by reference in its entirety.

FIELD OF THE DISCLOSURE

The present invention relates to an exercise system and method for combining walking poles with a stationary bicycle, as well as a stationary bicycle having walking pole attachments.

BACKGROUND

Stationary bicycles offer a myriad of positive health benefits. Stationary bicycles may be used by users having a variety of fitness levels. Accordingly, those who rarely exercise or who are beginners may find the stationary bicycle an easier exercise machine to utilize and one that is not high impact on the user's back or knees or other areas that may hurt when exercising. That being said, experienced exercisers also benefit when using a stationary bicycle because they can change the level of intensity and speed as needed to provide a challenging workout.

In general, exercising on a stationary bicycle is known for providing an excellent lower body workout that challenges the legs of the exerciser. Of course, exercising on the stationary bicycle also provides other health benefits including providing a great cardiovascular workout that benefits the heart and lungs of the user.

It may be possible to use hand weights or weighted cables while also pedaling on the stationary bicycle, but the weight of the hand weights or weighted cables may be too heavy for many people. Particularly, it may be too difficult for those people who are injured and are utilizing the stationary bicycle for rehabilitation purposes or are also elderly to also hold hand weights or weighted cables or other form of handheld exercise devices.

Accordingly, there is a need for a method for combining the stationary bicycle with a tool for working out the upper body that is not heavy and that also provides a free range of movement to perform upper body exercises while pedaling on a stationary bicycle or to balance and provide support when exercising on a stationary bicycle.

SUMMARY

The present description includes one or more embodiments for a stationary bicycle comprising a main frame having a left pedal and a right pedal attached to the main frame, as well as a seat post connected to the main frame on a lower end and a seat connected to the seat post on an upper end of the seat post, and a handlebar assembly. The stationary bicycle may further include a first walking pole attachment mounted to a left structural member of a left side of the handlebar assembly of the stationary bicycle and a second walking pole attachment mounted to a right structural member on a right side of the handlebar assembly of the stationary bicycle. In a non-limiting embodiment, the first walking pole attachment is attached to a top left horizontal member of the handlebar assembly of the stationary bicycle or to a top left vertical member of the handlebar assembly of the stationary bicycle. Further, in a non-limiting embodiment, the second walking pole attachment is attached to a top right horizontal member or a top right vertical member of the handlebar assembly of the stationary bicycle, whereby the first walking pole attachment and the second walking pole attachment are configured to hold one or more walking poles stored on the stationary bicycle for use while exercising on the stationary bicycle with the one or more walking poles. Further, in a non-limiting embodiment, the first walking pole attachment and the second walking pole attachment are removably attachable to the handlebar assembly of the stationary bicycle and can be repositioned from a first position to a second position on the handlebar assembly of the stationary bicycle.

Further, the first walking pole attachment and the second walking pole attachment may each include an angled left arm, an angled right arm, wherein the angled left arm and the angled right arm angle or incline away from the base portion and define a wider cavity or gap between the left arm and the right arm, whereby there is no cover or barrier connecting a top surface of the angled left arm and a top surface of the angled right arm. In a first non-limiting embodiment, the first walking pole attachment and the second walking pole attachment may be bendable and pliable such that the interior gap of the walking pole attachment may be expanded or narrowed to best fit the size of the walking poles stored therein.

The present description includes a second embodiment for the first walking pole attachment and the second walking pole attachment, whereby the first and second walking pole attachments each include a clamping portion configured to be fastened around a structural member of the handlebar assembly of the stationary bicycle, whereby the clamping portion of the first walking pole attachment and the clamping portion of the second walking pole attachment is attached to the left structural member of the handlebar assembly and the right structural member of the handlebar assembly, respectively, of the stationary bicycle. The second embodiment for the first and second walking pole attachments may further include a flat horizontal piece extending outwardly away from the clamping mechanism that connects with a flexible angled arm configured to angle away from the flat horizontal piece.

In a non-limiting embodiment, the first walking pole attachment and the second walking pole attachment is attachable to face upwards or sideways, whereby when the first walking pole attachment and the second walking pole attachment face upwards, the one or more walking poles are configured to lay across a top of the handlebar assembly in a horizontal orientation. Further, when the first walking pole attachment and the second walking pole attachment face sideways, each walking pole of the one or more walking poles is configured to extend vertically against a closed portion or stopping piece of the first and second walking pole attachments and to each side of the handlebar assembly of the stationary bicycle. Accordingly, the first and second walking pole attachments may be orientated in a myriad of orientations to the preference of the user whether to stand the one or more walking poles vertically against each side of the handlebar assembly or whether to lay the one or more walking poles across a top surface of the handlebar assembly.

In a non-limiting embodiment, the stationary bicycle may further include a first resistance band mounting attachment attached to a rear portion of the seat post or other structural member of the stationary bicycle and a second resistance band mounting attachment attached to the rear portion of the seat post or other structural member of the stationary bicycle. In a non-limiting embodiment, the first resistance band mounting attachment and the second resistance band mounting attachment may further include a clamping portion configured to be fastened around the rear portion of the seat post or other structural member of the stationary bicycle and a flat horizontal piece extending outwardly away from the clamping mechanism that connects with a flexible angled arm configured to angle away from the flat horizontal piece. In a non-limiting embodiment, each resistance band mounting mechanism may further include a first cylinder and a second cylinder mounted over each resistance band mounting mechanism. For example purposes only, in a non-limiting embodiment, the first cylinder and the second cylinder are made entirely or in part of foam material, although other materials may be used in alternative embodiments.

The present description further includes a method for exercising with a pair of walking poles, whereby the method may include positioning oneself on a seat of a stationary bicycle, grasping one or more walking poles of the pair of walking poles, whereby each pole of the pair of walking poles comprises an elongated body having a slim profile and a narrow diameter. The method may further include pedaling the pedals of the stationary bicycles while selectively performing exercises that benefit an upper body and an upper torso of a user using the pair of walking poles. In this exemplary method, each pole of the pair of walking poles weighs no more than 16 ounces (or 1 pound), is at least 24 inches long, and is no more than 2 inches wide in diameter.

The method may further include attaching a first walking pole attachment to a left structural member of a left side of the handlebar assembly of the stationary bicycle and attaching a second walking pole attachment mounted to a right structural member of a right side of the handlebar assembly of the stationary bicycle, whereby the first walking pole attachment is attached to a top left horizontal member of the handlebar assembly of the stationary bicycle or to a top left vertical member of the handlebar assembly of the stationary bicycle. Further, the second walking pole attachment is attached to a top right horizontal member or a top right vertical member of the handlebar assembly of the stationary bicycle, whereby the first walking pole attachment and the second walking pole attachment are configured to hold one or more walking poles stored on the stationary bicycle for use while exercising on the stationary bicycle with the one or more walking poles.

In a preferred non-limiting embodiment, the first and second walking pole mounting attachments are removably attachable to the handlebar assembly. Further, the first and second walking pole mounting attachments may be oriented facing upwards to hold the walking poles across the handlebar assembly across a top surface of the handlebar assembly in a horizontal orientation. Alternatively, the first and second walking pole mounting attachments may be attached to face sideways, such that each walking pole may be stored or contained within an interior portion of the first and second walking pole mounting attachments and lean against a side of the handlebar assembly 104 and to each side of the stationary bicycle.

The method may further include alternating raising one or more of the walking poles from a ground surface in an upward motion on a left or right side of a user on the stationary bicycle.

The method may further include pedaling on the stationary bicycle while holding a left walking pole and a right walking pole of the pair of walking poles, while holding the left walking pole and the right walking pole for balance while pedaling on the stationary bicycle, whereby a bottom end tip of the left walking pole and a bottom end tip of the right walking pole is touching or almost touching a ground surface. The method may further include performing exercises that benefit the back and shoulders by using only a single pole of the pair of walking poles while pedaling on the stationary bicycle.

The method may further include performing a first resistance exercise that includes pushing down on each pole of the pair of walking poles while pedaling and holding this pushed down position for a short period of time and then releasing the pushed down position, sitting back up, and then repeating one or more times the first resistance exercise.

The method of pole biking as described herein may be beneficial for incorporating light to moderate intensity in a workout and integrating a greater range of movement and flexibility in the upper body and the upper torso for the user Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
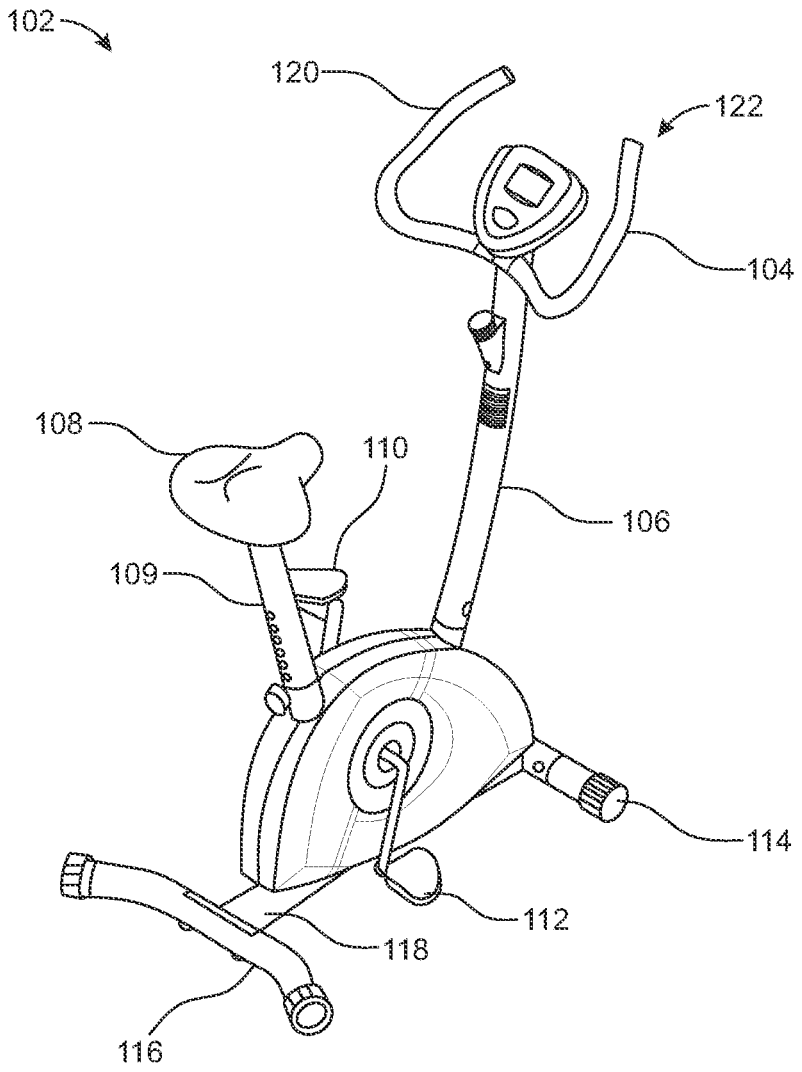
FIG. 1 (PRIOR ART)
FIG. 1 is a pictorial illustration of a prior art stationary bicycle in accordance with an illustrative embodiment.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "set" as used herein may refer to one or more items. Accordingly, "set" may mean a single item or more than one item.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa.

The present description includes embodiments for a workout method and system that combines a stationary exercise bicycle with a set of walking poles. Advantageously, numerous exercises targeting the upper body and core of a user may be performed while engaging the walking poles and pedaling on a stationary bicycle that are beneficial to the health of the user. Further, incorporating walking poles when exercising on a stationary bicycle may provide additional flexibility, movement, and balance to the traditional method of stationary biking. The combination of integrating walking poles while exercising on a stationary biking may be referred to herein as pole biking in one or more non-limiting embodiments. In the combination of stationary biking and walking poles, a better form of exercise is provided in which the user can benefit from the stationary bicycle while also incorporating a lightweight tool, such as one or more walking poles that can increase the intensity of the workout (without overly straining the user), and help with a greater range of flexibility, movement, and balance on the stationary bicycle. The present description provides several examples of exercises that may be performed using one or more walking poles on a stationary bicycle.

Further, the present description includes one or more non-limiting embodiments for attachments that may be mounted to one or more portions of the handlebar assembly of the stationary bicycle and used to store the walking poles on the stationary bicycle as needed when not in use. Further details are provided with respect to the Figures.

Turning to FIG. 1, FIG. 1 is a pictorial illustration of a traditional or prior art stationary bicycle 102. As known by those of ordinary skill in the art, stationary bicycles 102 may be used for exercising. Stationary bicycles 102 are stationary and do not move in a forward or other direction like a traditional bicycle.

Figure 2A:
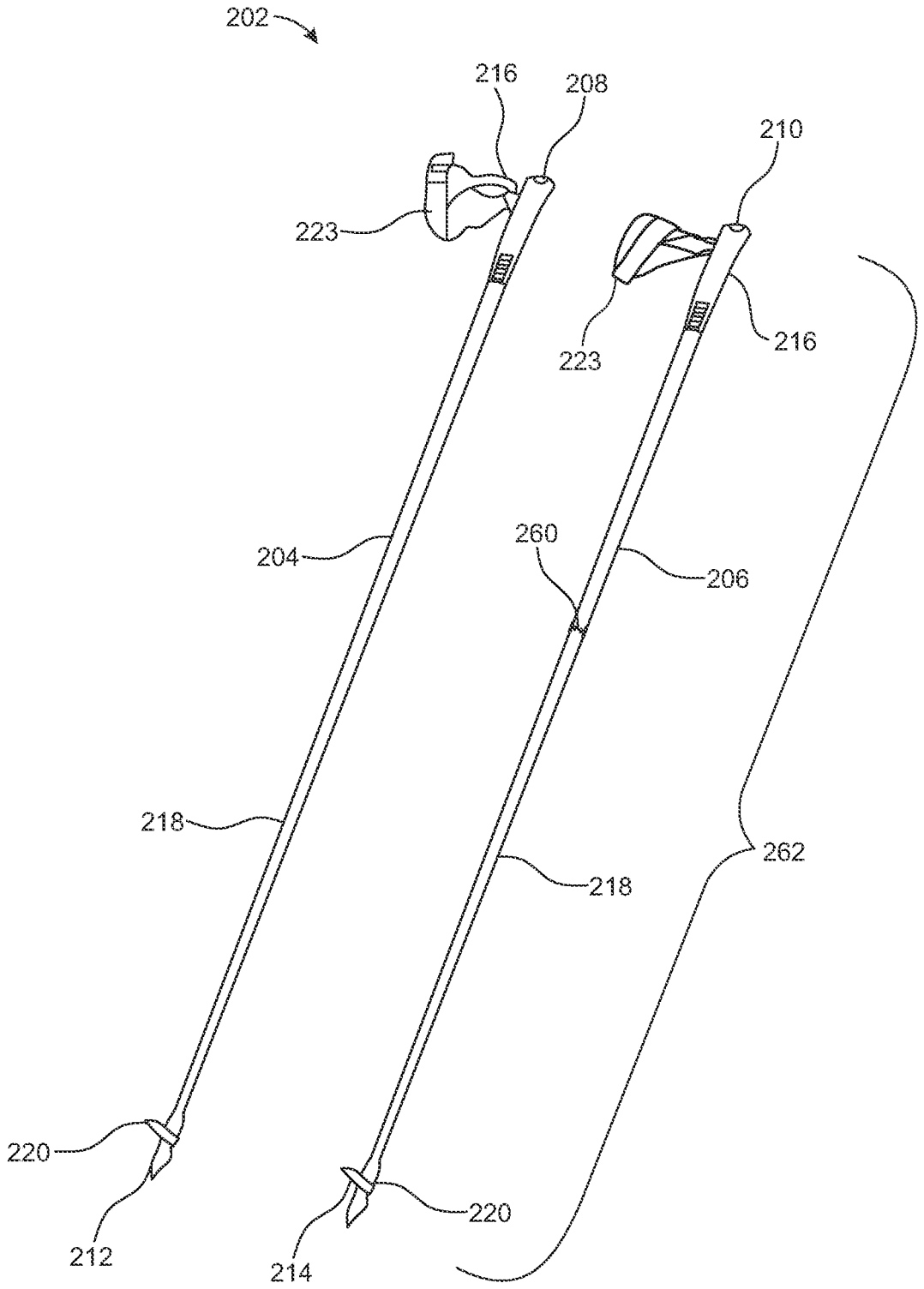
FIG. 2A (PRIOR ART)
FIG. 2A is a pictorial illustration of a prior art set of walking poles in accordance with an illustrative embodiment.
Figure 2B:
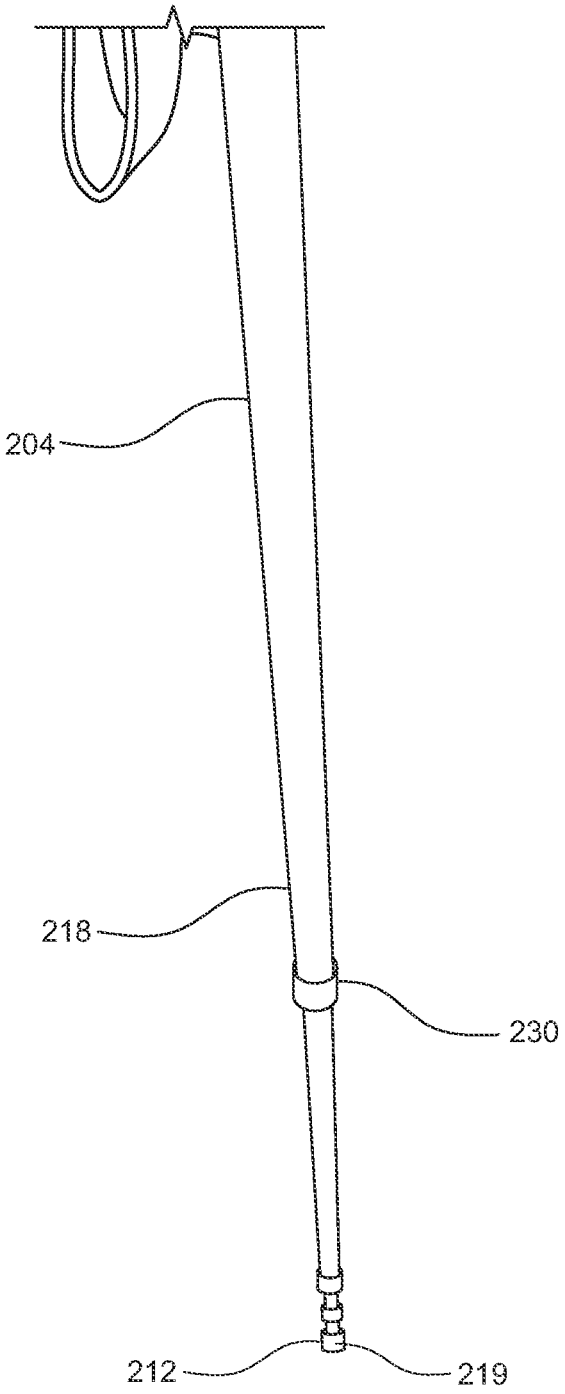
FIG. 2B (PRIOR ART)
FIG. 2B is a pictorial illustration of another exemplary prior art walking pole in accordance with an illustrative embodiment.
Figure 2C:
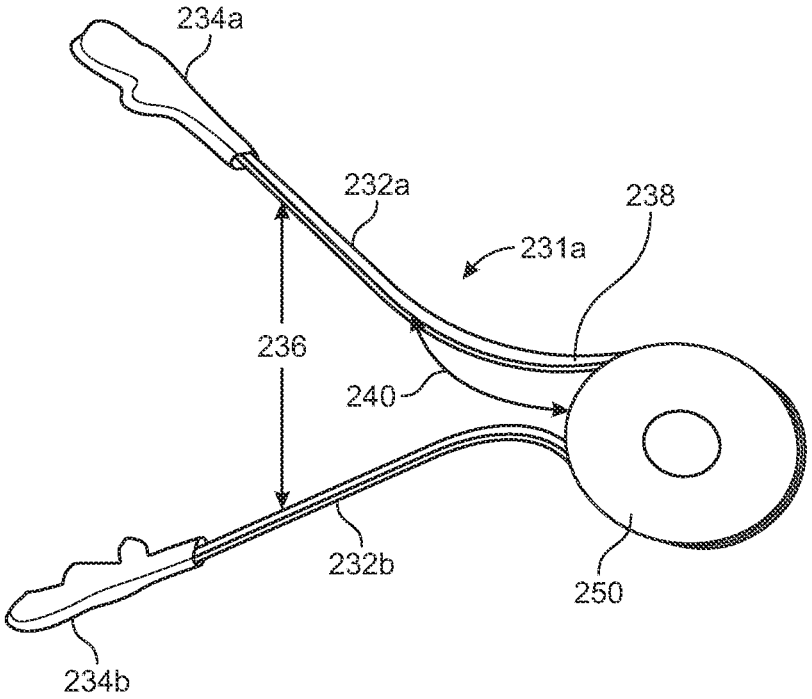
FIG. 2C is a pictorial illustration of a first embodiment of a walking pole attachment mechanism in accordance with an illustrative embodiment.
Figure 3:
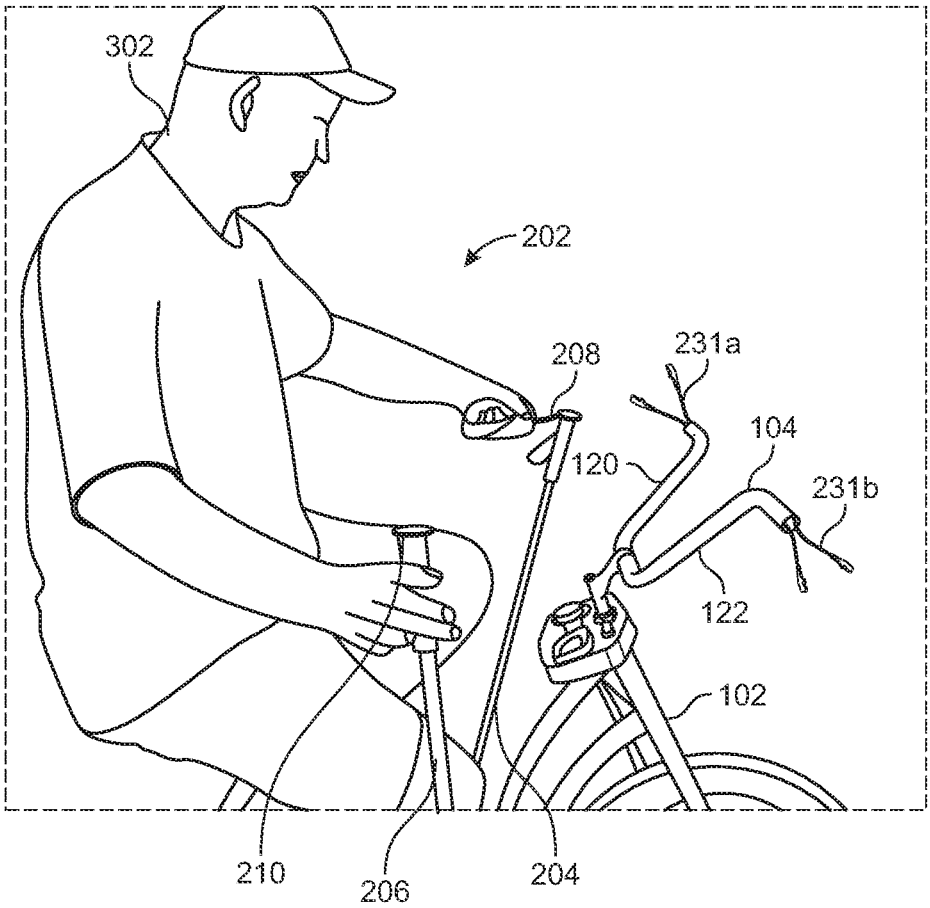
FIG. 3 is a pictorial illustration of a user on a stationary bicycle incorporating the set of walking poles while exercising on the stationary bicycle in accordance with an illustrative embodiment.
Figure 6:
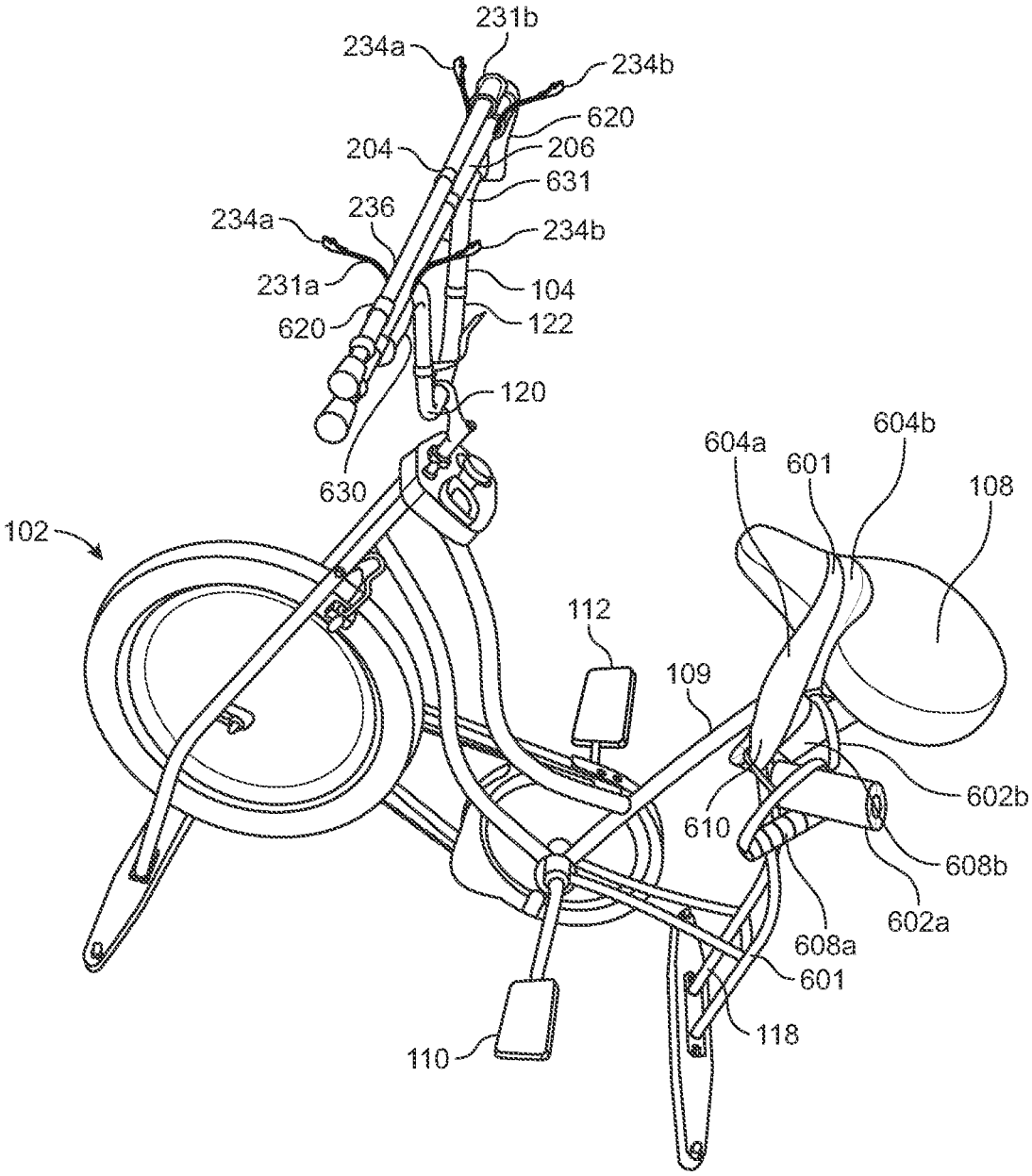
FIG. 6 is a pictorial illustration of an exemplary stationary bike with walking poles stored on a top surface of the handlebars on the mounted walking pole attachments as well as a resistance band and a set of resistance band mounting mechanisms.
Figure 10:
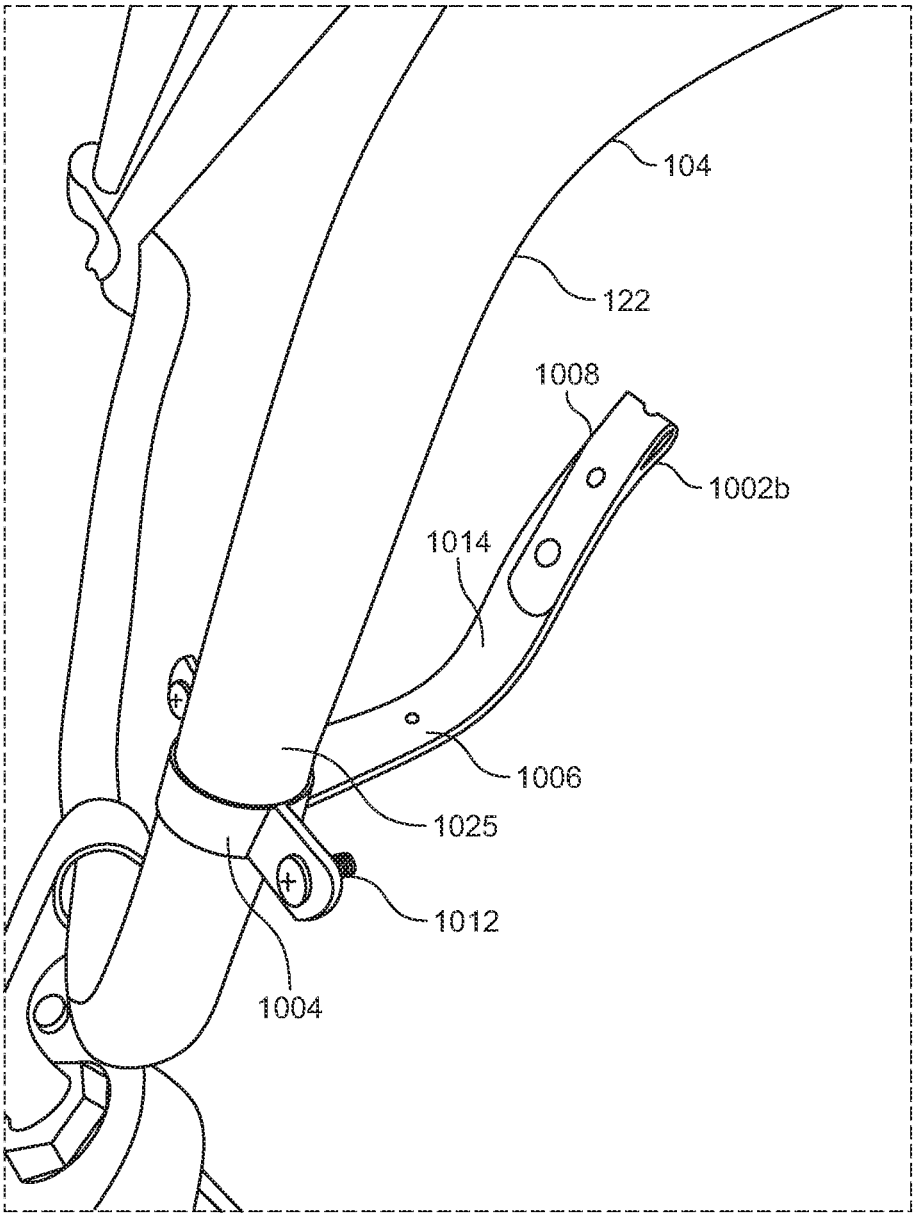
FIG. 10 is a pictorial illustration of a second embodiment for walking pole attachments for attaching to a stationary bicycle.
Figure 11:
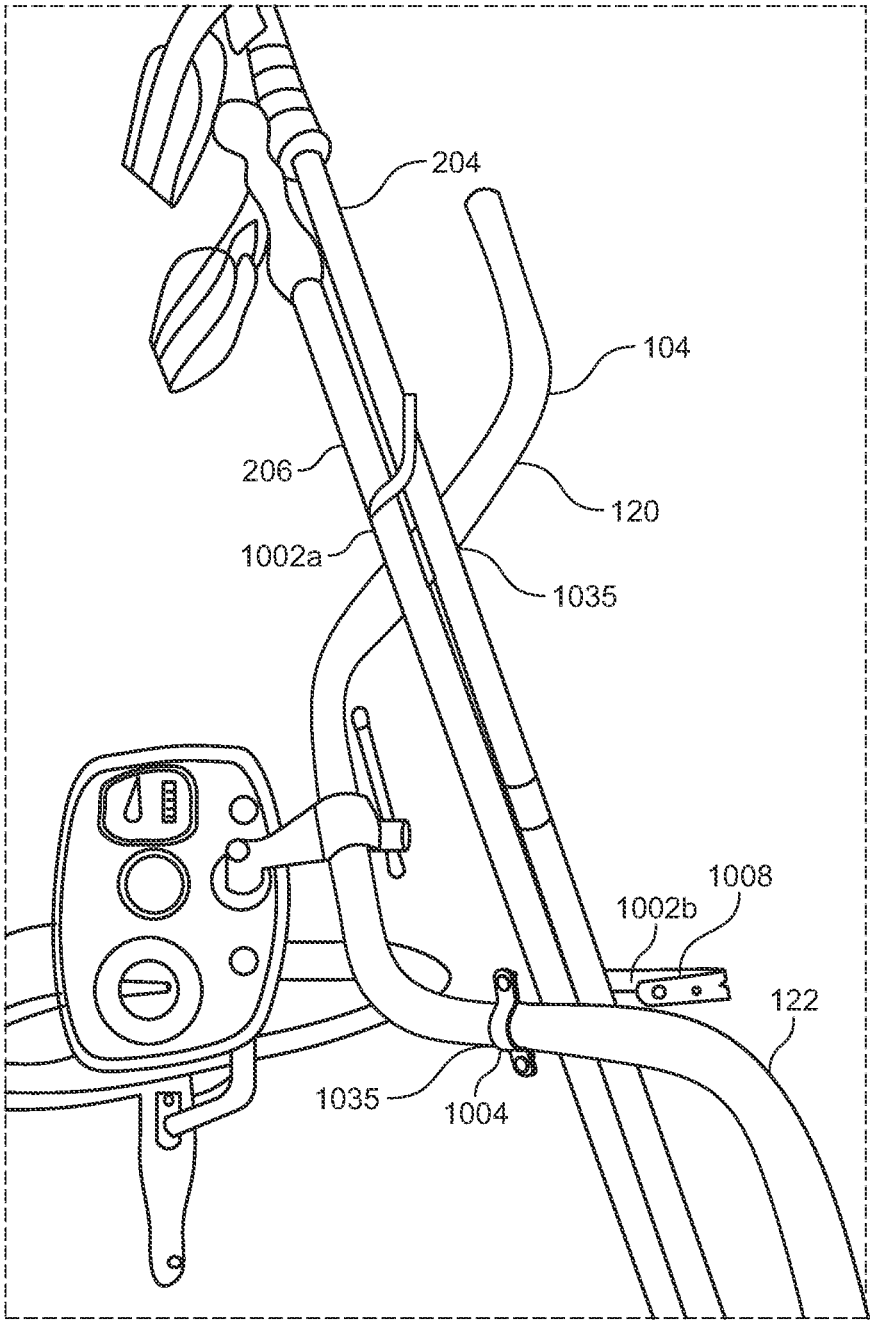
FIG. 11 is a pictorial illustration of a top view of a stationary bicycle with the walking poles stored on the walking pole attachments shown in FIG. 10.

Stationary bicycle 102, as shown in FIG. 1, may be used to perform one or more exercises in combination with a set of walking poles (e.g., walking poles 202 as shown in FIG. 2) and further described below, and in particular when adapted to include one or more walking pole attachment mechanisms, such as a first embodiment of walking pole attachment mechanisms 231*a* and 231*b* as shown in FIG. 3 or FIG. 6, or a second embodiment for walking pole attachment mechanisms 1002*a* and 1002*b* as shown in FIGS. 10-11.

As shown in FIG. 1, the basic components of stationary bicycle 102 may include a handlebar assembly 104. The stationary bicycle 102 shows one type of handlebar assembly 104. It is known in the art that there may be other types of handlebar assemblies 104 for various other models of stationary bicycles 102 having different structures. Some handlebar assemblies 104 may have raised platforms with a larger surface area extending horizontally across. Some handlebar assemblies 104 may include a digital touch screen with other buttons and selectors that may be selected by the user (e.g., user 302 as shown in FIG. 3). The system and method as described herein for incorporating walking pole attachments (e.g., as shown in FIG. 2C-14) may be implemented on any type of handlebar assembly 104 for any type of stationary bicycle 102.

In FIG. 1, the handlebar assembly 104 is connected to an upright frame pole 106 which connects to the main frame 118 of the stationary bicycle 102. Further, the upright pole 106 may connect to the front stabilizer 114, which is also a component of the main frame 118. The stationary bicycle 102 may also include a rear stabilizer 116.

The stationary bicycle 102 may further include a seat 108 on which the user may be seated. The seat 108 connects via a seat post at a top end of the seat post 109 to the main frame 118 of the stationary bicycle 102. The stationary bicycle 102 may further include a left pedal 110 and a right pedal 112 that are configured to spin and rotate when the user engages with the pedals with his or her feet. The handlebar assembly 104 of the stationary bicycle 102 may include at least two handles or structural members (e.g., structural members 120 and 122) on either side of the user for a user to hold onto while seated on the seat 108 of the stationary bicycle 102 and while pedaling the pedals 110 and 112 of the stationary bicycle 102. Structural member 120 may generally refer to a left structural member of the handlebar assembly 104 and structural member 122 may refer to a right structural member of the handlebar assembly 104. The left handle area of the handlebar assembly 104 may encompass a substantially horizontal portion (e.g., horizontal portion 630 as shown in FIG. 6) and a substantially vertical portion (as shown in FIG. 1) that connect together in one or more arrangements to generally form the handlebar assembly 104 of the stationary bicycle 102. The stationary bicycle 102 may include multiple other components as shown in FIG. 1 and as understood by one of ordinary skill in the art.

Stationary bicycles 102 are also known as exercise bicycles. There may be many models of a stationary bicycle 102. Some may have a higher handlebar assembly 104 as compared to others in which the handlebar assembly 104 is raised higher than the seat 104. Others have the seat 108 about level with the handlebar assembly 104 or at least provide the option for the user to raise and lower the seat 108 and/or handlebar assembly 104 to a desired level. Some stationary bicycles 102 further include an enclosed base frame while other stationary bicycles 102 have a more open frame structure that is not enclosed as shown in FIG. 1.

As used herein, the term "stationary bicycle" can also encompass or mean spin bicycles, which is a specific type of stationary exercise bicycle 102. Spin bicycles typically have a flywheel incorporated on a front or back part of the frame of the bicycle. The flywheel is a large, weighted spinning wheel, and the user must exert some more force and effort to cause the flywheel on a spin bicycle to go or to stop. Spinning is a type of stationary bicycling that uses a spin bicycle. Accordingly, the embodiments for walking poles attachments as discussed further on herein and the various exercises described below may be incorporated on any type of stationary exercise bicycle 102, as known or as yet to be developed, including, but not limited to, spin bicycles.

It is noted that stationary bicycles 102 are frequently used in an indoor setting as the user is exercising. However, stationary bicycle 102 may be placed in any setting the user desires including an outdoor setting, such as, but not limited to, a grassy area, field, porch, backyard, etc.

FIG. 2A shows a pictorial illustration of a prior art set of walking poles, such as walking poles 202. Walking poles 202 may also be referred to as trekking poles. Walking poles 202 are a type of walking pole that are typically used by walkers or hikers to add stability and support when walking or hiking. In one or more non-limiting embodiments, walking poles 202 may comprise a left walking pole 204 and a right walking pole 206. The left walking pole 204 may include a handle 208 located at the top end 216 of the left walking pole 204. The right walking pole 206 similarly may include a handle 210 located at the top end 216 of the right walking pole 206. As shown in FIG. 2A, some walking poles 202 have in essence two handles, in that the top portions 208, 210 of each walking pole 204, 206 can be grasped and serve as a "handle" or there may be separately hanging handles 223 on each walking pole 204, 206 as shown in FIG. 2A that the user can alternatively grasp or insert his or her hand through.

Additionally, each walking pole 204, 206 includes an upright, elongated body 218 that extends from the top ends 216 to the bottom ends 220 of the walking poles 204, 206. In one or more non-limiting embodiments, the walking poles 204, 206 may each respectively include a bottom tip 212, 214 at the bottom ends 220 of each walking pole 204, 206. For many walking poles, such as walking poles 204, 206 as shown in FIG. 2A, the tips 212, 214 may be pointed in shape. This may be because walking poles 204, 206 are typically used to provide support and stability to walkers and hikers and the pointed end may be best suited for digging into the ground for additional support and stability. However, it is noted, that in other embodiments, the tips 212, 214 of the walking poles 204, 206 are not required to be pointed, but rather may be rounded or square or any other shape instead.

Figure 8:
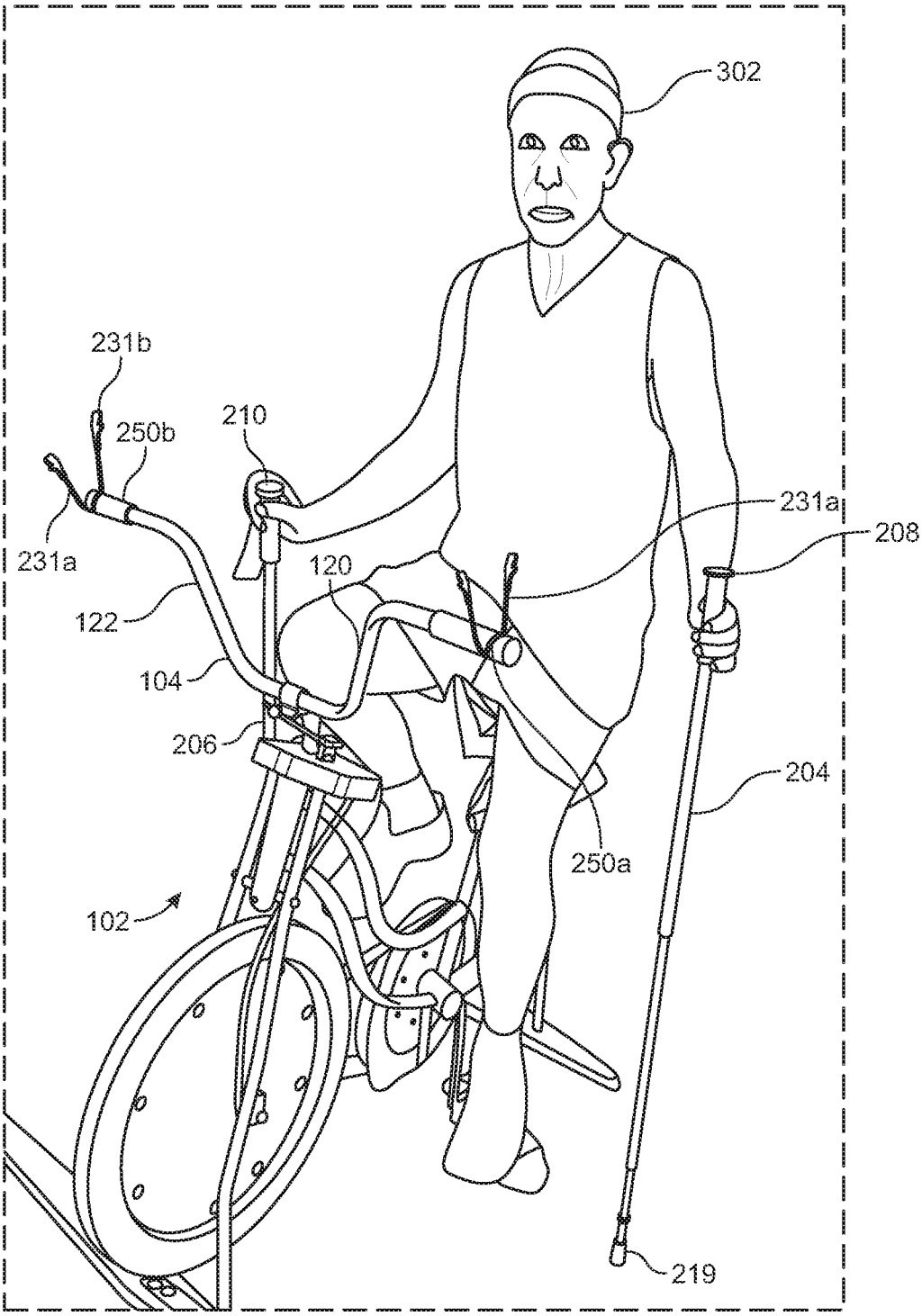
FIG. 8 is a pictorial illustration of a user on the stationary bicycle that has the mounted walking pole attachments whereby the user is using the walking poles to balance on the stationary bicycle.

The length or height 262, as shown in FIG. 2A, of the walking poles 204, 206 may be longer in size. In a non-limiting embodiment, it may be preferable that the length or height 262 of the walking poles 204, 206 is at least 2 inches long and may range to 6 or 7 feet or longer if needed or shorter. One of the intended goals of using the walking poles 204, 206 when working out on the stationary bicycle 102, as shown for example in FIG. 8 is to be able to have a bottom tip (e.g., tips 212, 214 as shown in FIG. 2A and FIG. 2B) touch a ground surface such that the user can use the walking poles 204, 206 to balance while pedaling. In other words, while the user is pedaling on the stationary bicycle 102, if the user desires, the walking poles 204, 206 can be grasped in each hand and used for additional support and balance as the user pedals and while the end tips 212, 214 of the walking poles 204, 206 touches a ground surface. As noted later below, the walking poles 202 are not permanently attached to the sides or other portions of the stationary bicycle 102 and the user can still raise and lower the walking poles 204, 206 over a variety of angles and positions to perform a variety of exercises.

As noted above, the walking poles 204, 206 may have a very elongated body 218 with a very slim profile and a very narrow diameter 260. In other words, the diameter 260, as shown in FIG. 2A, of the walking poles 204, 206 may not be very wide at all, which is a characteristic feature of walking poles 204, 206 in general. In one or more non-limiting embodiments, the diameter 260 of each pole 204, 206 of the pair of walking poles 202 does not exceed 2 inches in size and may in fact be much narrower.

Each walking pole 204, 206 of the pair of walking poles 202 may notably be very lightweight. Contrary to the intention of most workouts, in which users employ weights and weight bars by holding them in their hands and performing upper body exercises while pedaling or while seated on the stationary bicycle 102, when utilized for pole biking as described herein, the pair of walking poles 202 should not add a great deal of weight to the user to carry, whether individually or as a pair. In a preferred, non-limiting embodiment, each walking pole 204, 206 may weigh no more than 16 ounces or 1 pound each. It is more typical for each walking pole 204, 206 to be about 1-10 ounces, and are each very lightweight. Other ranges of weights may alternatively be used and one of ordinary skill in the art understands these numbers are exemplary for weight, length 262, and diameter 260 of each walking pole 204, 206.

FIG. 2B shows another prior art example of an exemplary walking pole 204. As shown in FIG. 2B, the end tip 212 of walking pole 204 is not pointed. Further, walking pole 204 may be an example of a telescoping walking pole whose height can be changed by manipulating a height changing mechanism 230 integral with each walking pole 204, 206. The user may increase or decrease the height 262 of the walking poles 202 as the user desires by engaging the height changing mechanism 230 to raise and lower the walking pole 204 to a suitable height 262 as desired. This may be particularly necessary as users come in different heights and sizes and may need to adjust the height 262 of the walking poles 202.

Further, as shown in FIG. 2B, for some existing walking poles 202, the end tip 212 may incorporate a rubber piece 219 at the end tip 212 that has push back or recoil such that if a user presses down on the walking poles 204, 206, the rubber piece 219 provides some resistance and pushes back in an upward direction. This element may be useful in one or more exercises as described further below.

FIG. 2C shows an example of a first embodiment of a walking pole attachment 231*a*. In a non-limiting embodiment, at least two of such walking pole attachments 231*a* and 231*b*, as shown for example in FIGS. 3-14), may be attached or mounted on a stationary bicycle 102. The walking pole attachments 231*a*,231*b* function to store the walking poles 202 on the stationary bicycle 102 when the user is only using one walking pole 204,206 or when the walking poles 202 are not being used. Advantageously, walking pole attachments 231*a*,231*b* may be mounted to a handlebar assembly 104 of any type of stationary bicycle 102, including a spinning type of stationary bicycle 102 or a non-spinning type of stationary bicycle 102 (e.g., as shown for example in FIG. 1 which does not have a spinning wheel).

As shown in FIG. 2C, each walking pole attachment 231*a*, 231*b* may include a first arm 232*a* and a second arm 232*b* that angles away at an angle 240 from a base portion 238. The first arm 232*a* and the second arm 232*b* join the base portion 238 which has a terminal, closed end point. The base portion 238 may define a cavity or gap and join with the angled first arm 232*a* and second arm 232*b* and the base portion 238 may form a "U" shape around the cavity or gap.

There may be a top piece 234*a*, 234*b* at the end of each angled arm 232*a*, 232*b* in one or more non-limiting embodiments. In one or more non-limiting embodiments, the top piece 234*a*,234*b* may be made of rubber or some other cushioned material, such as but not limited to foam. The first and second angled arms 232*a*, 232*b* may have a wide gap 236 that increases from the base portion 238 where the first and second arms 232*a*, 232*b* join with the base portion 238 towards the ends of the first and second angled arms 232*a*, 232*b* (including the ends of the top pieces 234*a*, 234*b*). In a non-limiting embodiment, there may not be any cover or barrier connecting the top ends of the angled arms 232*a*, 232*b* as shown in FIG. 2C such that the gap 236 is not covered by anything and is exposed to the surrounding air.

As shown in FIG. 2C, the walking pole attachment 231*a* has already been inserted onto or attached to a stationary bicycle handle 250. For some models of stationary bicycles 102, there are bicycle hands 250 and they may be removable. These bicycle handles 250 are usually made of a soft plastic, rubber, foam, or other softer material conducive to gripping and holding by one's hands. It is noted that in a non-limiting embodiment, if the user has a stationary bicycle 102 with a same or similar stationary bicycle handle 250, the user may attach the walking pole attachments 231*a*, 231*b* to the stationary bicycle handles 250 by inserting, press fitting, fastening, wrapping or otherwise positioning the base 238 of the walking pole attachment 231*a*,231*b* on the bicycle handle 250. Further options for attaching the walking pole attachments 231*a*,231*b* are discussed below.

In in a non-limiting embodiment, the angled arms 234*a*, 234*b* of the walking pole mounting attachments 231*a*,231*b* are thinner in size and are flexible, such that the angled arms 234*a*,234*b* may be bent or pulled to bring them closer together or bent or pulled to pull them farther apart. This may allow the angled arms 234*a*, 234*b* to be manipulated to accommodate various sizes and lengths of the walking poles 204,206 that the user 302 intends to use and store within the walking pole mounting attachments 231*a*,231*b* when mounted (e.g., temporarily and removably) to the handlebar assembly 104 of the stationary bicycle 102. Further, the base 238 of the walking pole mounting attachments 231*a*, 231*b* may be bendable also so the base 238 can be manipulated to best fit on or around a structural member (e.g., 120, 122 as shown in FIG. 1) of the handlebar assembly 104 whereby the user 302 or another party can squeeze, bend, or pull on the base 238 slightly to improve the fit of the base 238 on the structural members of the handlebar assembly 104. Accordingly, in a non-limiting embodiment, the walking pole mounting attachments 231 may be preferably made of a combination of soft plastic, metal, rubber, or any other type of material having a softer and more pliable composition.

As shown in FIG. 3, in one or more non-limiting embodiments, the system shown in FIG. 3 includes the combination of a set of walking poles 202 and the stationary bicycle 102. It is intended for a user to use a stationary bicycle 102 by sitting on the seat 108 of the stationary bicycle 102 and pedaling by moving forward the left 110 and right pedal 112 of the stationary bicycle 102. Further, the user may grasp the left walking pole 204 and the right walking pole 206 in either hand while pedaling on the stationary bicycle 102. Advantageously, the system shown in FIG. 3 provides a new method for exercising that integrates walking poles 204, 206 and bicycling on the stationary bicycle 102 simultaneously. Many advantages are offered by this system as shown in FIGS. 2C-14, which may be referred to also as "Pole-Biking."

The combination of the pair of walking poles 202 with the stationary bicycle 102 is very beneficial for users of all ages and fitness levels. Further, the addition of the pair of walking poles 202 allows the user to achieve a total body workout and workout the upper body and core as well as the typical lower body workout that happens when using a stationary bicycle 102. In particular, if the user's stationary bicycle 102 does not include movable arm handles, it is more difficult for the user to effectively achieve a total body workout, and therefore, the addition of the walking poles 204, 206 provides an alternative to using hand weights or other handheld exercises devices. It is noted that the system shown in FIG. 3 combining the pair 202 of walking poles 204,206 with the stationary bicycle 102 may be used for any type of stationary bicycle 102 whether the stationary bicycle 102 includes movable arm handles or not. The integration of the walking poles 202 may provide upper body activity and exercises without needing the stationary bicycle 102 to include movable arm handles.

Further, the combination of the pair of walking poles 202 with the stationary bicycle 102 provides for an easier way to exercise on the stationary bicycle 102 because the user has the support of the walking poles 202. Most beneficially, the use of the walking poles 202 in combination with the stationary bicycle 102 may assist the user to reduce joint paint or any type of pain that the user feels when exercising. The system shown in FIG. 3 may be particularly useful for physical therapy and rehabilitation of injured parties, elderly, or anyone needing a lower impact type of exercise system without limitation. Additionally, as further discussed below, the walking poles 202 and set of exercises that may be performed when pedaling on a stationary bicycle 102 provides a greater range and freedom of movement for the user.

When using the pair of walking poles 202 while pedaling on the stationary bicycle 102, the user may hold onto the left handle 208 of the left walking pole 204 and hold onto the right handle 210 of the right walking pole 206, which are located at the top ends 216 of the walking poles 204, 206. It is noted that while in use, the walking poles 204, 206 are not physically attached to the stationary bicycle 102 but rather are freely movable together and/or independently of one another. The mounting attachments 231*a* and 231*b* serve as holders that can hold or store the walking poles 204, 206 when the user 302 so wishes.

Depending on what exercise the user 302 is attempting to perform and whether the user 302 needs more stability, the user 302 may position the bottom tips 212, 214 of the walking poles 204, 206 on the ground surface while grasping the handles 208, 210 of the walking poles 204, 206, or may move the walking poles 204, 206 by raising and lowering the walking poles 204, 206 to the side in the air or above the user's head or behind the user as further described below and as shown in part in FIG. 9.

In one or more non-limiting embodiments, the user may also be able to advantageously store the pair of walking poles 202 on a set of mounting attachments, such as mounting attachments 231*a* and 231*b* shown in FIG. 2C and in FIG. 3, which are also attached to the stationary bicycle 102. Accordingly, when the user does not desire to hold the set of walking poles 202 in his or her hands or utilize the walking poles 202 while pedaling on the stationary bicycle 102, then the user has the option to lean, stand, or otherwise place the walking poles 202 against the mounting attachments 231*a* and 231*b* shown in FIG. 3.

Figure 4:
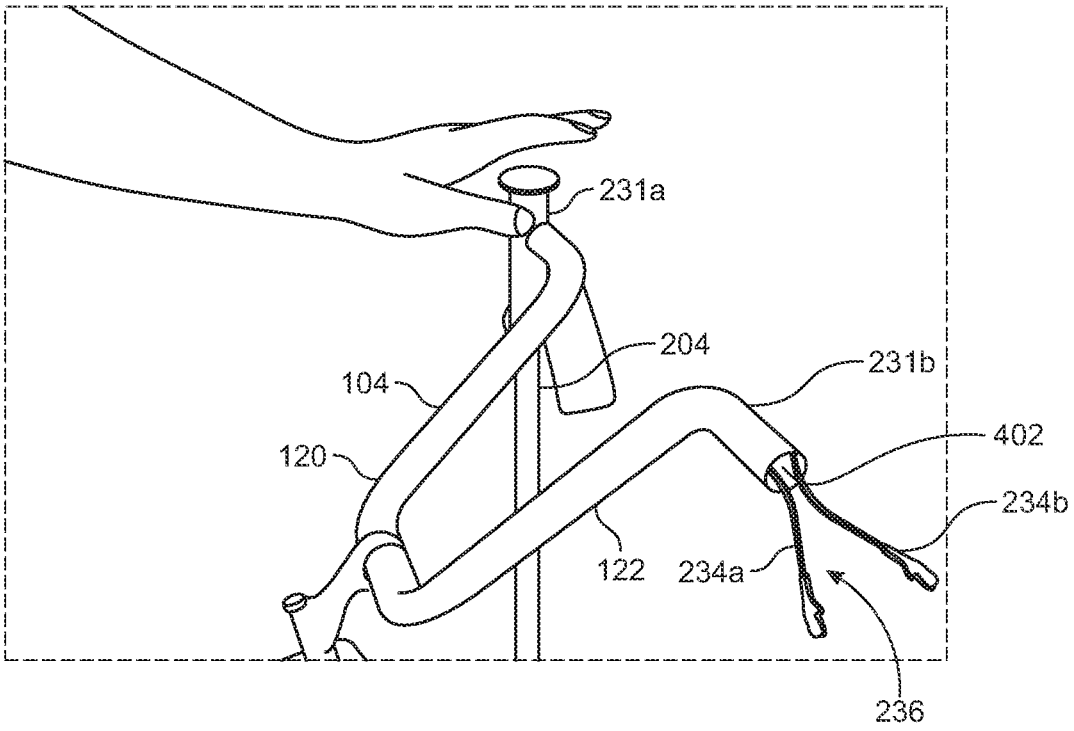
FIG. 4 is a pictorial illustration of the stationary bicycle with a set of mounted attachments for holding the walking poles on the stationary bicycle in accordance with an illustrative embodiment.

FIG. 4 provides another close up view of walking pole mounting attachment 231*b* in particular, which is identical to walking pole mounting attachment 231*a* that may be inserted or attached to the left side of the handlebar assembly 104 of the stationary bicycle 102. Accordingly, the left walking pole 204 may be configured to be stored and held within the opening 236, as shown in FIG. 2C, of the left walking pole mounting attachment 231*a*, and the right walking pole 206 may be configured to be stored and held within the opening 236 of the right walking pole attachment 231*b*. There is a myriad of ways in which the first walking pole mounting attachment 231*a* and the second walking pole mounting attachment 231*b* may be attached or held onto the handlebar assembly 104 of the stationary bicycle 102. FIG. 4 shows a non-limiting example in which there may be a hole or opening 402 at the end of the top horizontal piece of the handlebar assembly 104 of the stationary bicycle 102. The back end of the base 238, as shown in FIG. 2C, for each walking pole mounting attachment 231*a*, 231*b* may be inserted into this hole or opening 402 in the handlebar assembly 104 on the left and right side and held in place in such a manner. There may be other ways to attach the first and second walking pole mounting attachments 231*a*, 231*b* as further discussed below. FIG. 4 further shows that each walking pole mounting attachment, as represented by walking pole mounting attachment 231*b* in FIG. 4 includes a first angled arm 234*a* and a second angled arm 234 that extend away from the base 238 and interior cavity 236 and that are joined at a back, terminal end of the base 238. Each walking pole 204,206 is meant to fit respectively within the gap 236 of each walking pole mounting attachment 231*a*, 231*b*.

As shown in FIG. 3 and FIG. 4, in one or more non-limiting embodiments, the walking pole mounting attachments 231*a* and 231*b* may be attached to a handlebar assembly 104 of the stationary bicycle 102. In other embodiments, the walking pole mounting attachments 231*a* and 231*b* may be attached to another part of the stationary bicycle 102 (e.g., such as the upright pole 106, the back of the seat 108, or any other component of the stationary bicycle 102). Further, the walking pole mounting attachments 231*a*,231*b* may be either permanently or removably attached to the handlebar assembly 104 and/or another component of the stationary bicycle 102. If removably attached to the handlebar assembly 104, the position and/or orientation of the walking pole mounting attachments 231*a*, 231*b* may be changed selectively by the user and to accommodate the user's needs at the time for where he or she wants to store the walking poles 202 on the stationary bicycle 102 for easy access and reach when exercising on the stationary bicycle 102.

As shown in FIG. 3 and FIG. 4, in one or more non-limiting embodiments, the terminal end of the walking pole mounting attachments 231*a*,231*b* may be inserted into an opening 402 in either end of the handlebars 104. However, in other embodiments, the walking pole mounting attachments 231*a*, 231*b* may be attached in a different manner. For example, the walking pole mounting attachments 231*a*,231*b* may be fastened using any type of fasteners known in the art, such as, but not limited to screws, bolts, or another type of fastener. In some embodiments, the walking pole mounting attachments 231*a*,231*b* may be strapped onto the handlebar 104 of the stationary bicycle 102 using Velcro straps or wrapped wires. Accordingly, any means of attachment known in the art may be utilized.

Figure 5:
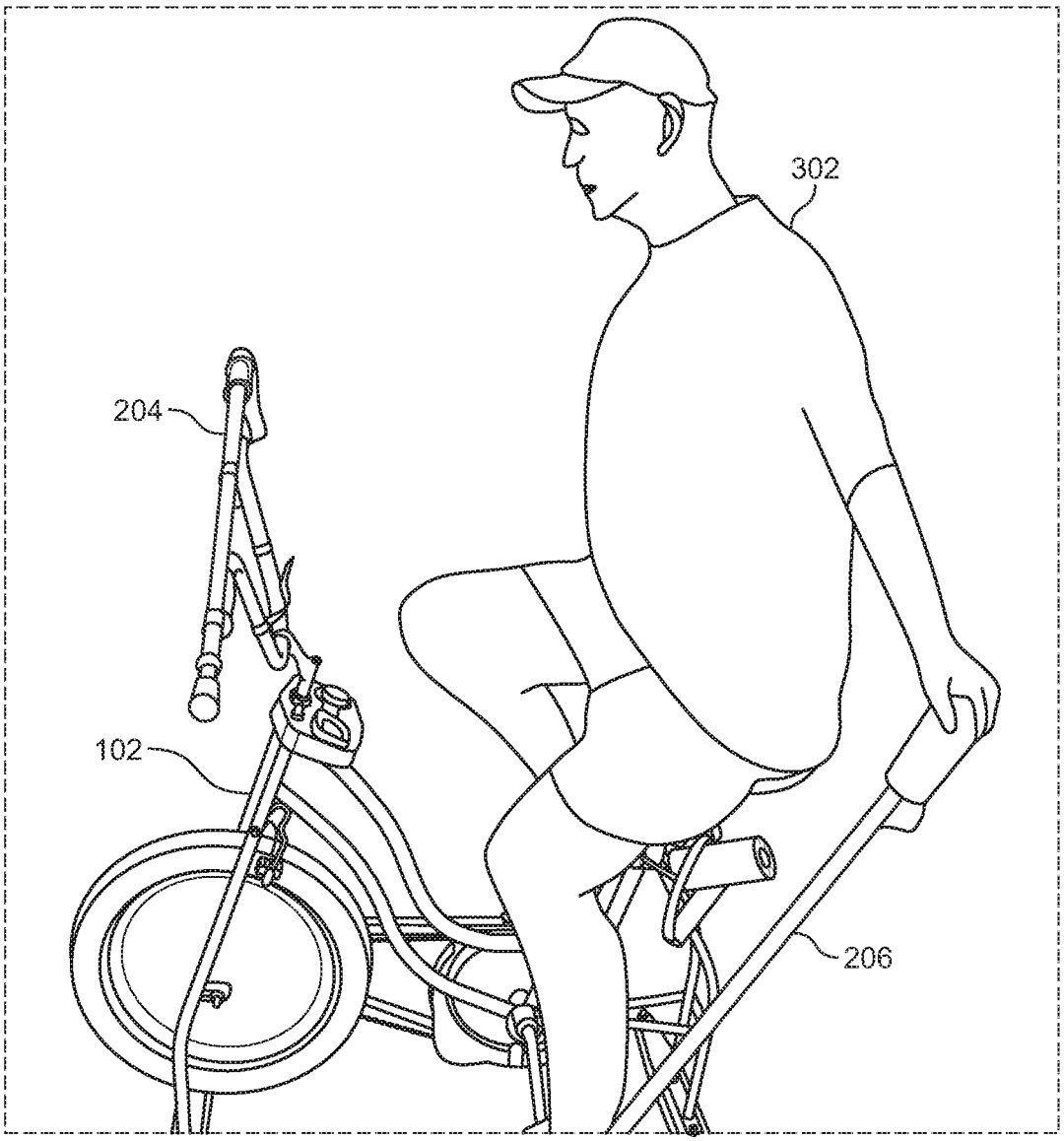
FIG. 5 is a pictorial illustration of a user on a stationary bicycle utilizing the set of walking poles in accordance with an illustrative embodiment.

FIG. 5 shows an example of walking pole 204 stored on the walking pole mounting attachments 231*a*, 231*b* shown in FIG. 2C. The user 302 is engaged in an exercise with one walking pole 206 which as shown in FIG. 5 is being moved by the user 302's left arm to the back and then front to work the user's 302 back and arm muscles. As shown in FIG. 5, the user may selectively engage in using one walking pole 204,206 at a time while pedaling or otherwise being seated on the stationary bicycle 102.

FIG. 6 shows a more in-depth view of the stationary bicycle 102 having multiple functions and features. As shown in FIG. 6, there are two walking pole mounting attachments 231*a*,231*b* joined or attached to the handlebar assembly 104. The first walking pole mounting attachment 231*a* is joined or attached at attachment point 620 to a left structural member 120 of the handlebar assembly 104.

Conversely, the right walking pole mounting attachment 231*b* is attached at its respective attachment point 620 to a right structural member 122 of the handlebar assembly 104.

As shown in FIG. 6, each walking pole mounting attachment 231*a*, 231*b* includes a first arm 234*a*, second arm 234*b*, and interior gap 236 between the first arm 234*a* and second arm 234*b*. In the non-limiting embodiment shown in FIG. 6, the walking pole mounting attachments 231*a*, 231*b* may be oriented facing upwards such that the angled arms 234*a*, 234*b* and interior gap 236 are oriented and facing upwards. The terminal end of the base 238 of the first walking pole mounting attachment 231*a* is attached to the top horizontal member 630 of the left structural member 120 of the handlebar assembly 104. Conversely, the terminal end of the base 238 of the second walking pole mounting attachment 231*b* is attached to the top horizontal member 631 of the right structural member 122 of the handlebar assembly 104.

In the example shown in FIG. 6, the first and second walking pole mounting attachments 231*a*, 231*b* are generally aligned in a lateral direction along a top surface of the handlebar assembly 104 with the first and second walking pole mounting attachments 231*a*, 231*b* facing upwards and the gaps 236 of each walking pole mounting attachment 231*a*,231*b* exposed. There are no barriers or covers covering the gaps 236 of the walking pole mounting attachments 231*a*, 231*b* in a non-limiting embodiment such that it is easy for the user 302 to place each walking pole 204, 206 in the attached first and second walking pole mounting attachments 231*a*,231*b* and remove them quickly.

As shown in FIG. 6, the walking poles 204, 206 are stacked on top of each other and resting within the gaps 236 of the attached first and second walking pole mounting attachments 231*a*, 231*b* that are attached to the handlebar assembly 104. The walking poles 204,206 extend in a horizontal orientation or direction across the top surface of the handlebar assembly 104.

In other non-limiting embodiments, the first and second walking pole mounting attachments 231*a*, 231*b* may be oriented facing sideways such that the angled arms 234*a*, 234*b* and interior gap 236 face to the sides instead of upwards. Such an example is shown in FIG. 3 and FIG. 4, in which the walking pole mounting attachments 231*a*,231*b* are oriented facing sideways in which the angled arms 234*a*,234*b* of the first and second walking pole mounting attachments 231*a*, 231*b* are oriented facing sideways. The walking poles 204,206 may be placed within the interior gap 236 of each walking pole mounting attachment 231*a*,231*b* and stand vertically against the sides of the handlebar assembly 104, as shown in FIGS. 3 and 4, such that each walking pole 204,206 is stored in a vertical orientation on each lateral side of the handlebar assembly 104 instead of extending across the top surface of the handlebar assembly 104, which is shown in FIG. 6.

Accordingly, a user 302 can select the best configuration and set up for his or her stationary bicycle 102 whether the user 302 prefers to attach the walking pole mounting attachments 231*a*, 231*b* having an upwards facing orientation that when aligned can hold the walking poles 204,206 in a horizontal orientation across a top surface of the handlebar assembly 104 or another location on the stationary bicycle 102, or whether the user 302 prefers to attach the walking pole mounting attachments 231*a*,231*b* having a sideways orientation that allows each walking pole 204, 206 to be stored in its respective gap 236 without falling to the floor and staying upright in a vertical orientation to the sides of the handlebar assembly 104.

It may be preferable for the walking pole mounting attachments to be attached to a handlebar assembly 104 so that the walking poles 204, 206 when stored or mounted do not interfere with the pedaling or seating of the stationary bicycle 104. In the embodiments shown in FIG. 3-6, the walking poles 204,206 can easily be stored without having any discomfort to the user 302 in reaching behind the user 302 or stretching too far. Further, the placement of the walking pole mounting attachments 231*a*,231*b* does not interfere with any other functions of the stationary bicycle 102.

As noted above, there are many models of stationary bicycles 102, further including spin bicycles. Some of the handlebar assemblies 104 may have a raised elevated platform with more structural members and/or digital screens. The user 302 can choose selectively where to position the walking pole mounting attachments 231*a*,231*b* on any of the structural members (e.g., structural member 120, 122) of the handlebar assembly 104 of their specific stationary bicycle 102. If the handlebar assembly 104 includes a digital screen and it is difficult to attach the walking pole mounting attachments 231*a*, 231*b* facing upwards and storing the walking poles 204, 206 across the top surface of the handlebar assembly 104, it may then be preferable to attach the walking pole attachments 231*a*, 231*b* to each side of the handlebar assembly 104 facing sideways and allow the walking poles 204, 206 to stand vertically and lean against the handlebar assembly 104 contained within the walking pole attachments 231*a*, 231*b*.

In a preferred embodiment, the walking pole mounting attachments 231*a*, 231*b* are removably attached to the handlebar assembly 104 of the stationary bicycle 102 by various means, including by removable fasteners, VELCRO, or removable wires or cords or cables.

Further, in another preferred non-limiting embodiment, the walking pole mounting attachments 231*a*, 231*b* can be press fit in place and fit around a structural member 120,122 of the handlebar assembly 104 without fasteners, VELCRO, or removable cords or cables. In such a case, the interior cavity or gap of the base 238, as shown in FIG. 2C is adapted to receive the structural member 120, 122 whereby the user 302 or another party press fits the walking pole mounting attachment 231*a*, 231*b* in place on the specific structural member 120,122 of the handlebar assembly 104 and orients the arms 234*a*,234*b* of the walking pole mounting attachments 231*a*,231*b* to face in the desired direction and orientation (e.g., whether upwards or to the sides). Accordingly, the user 302 or another party takes the walking pole mounting attachments 231*a*, 231*b* with the arms 234*a*, 234*b* angling away and the interior cavity of the base 238 exposed, and pushes or otherwise manipulates the walking pole attachments 231*a*, 231*b* onto the structural members 120, 122 of the handlebar assembly 104 and in the orientation (e.g., facing upwards or sideways) that the user 302 desires.

The user 302 can then easily pull off the walking pole mounting attachments 231*a*,231*b* and move to another location on the handlebar assembly 104 when desired. As noted above, the walking pole mounting attachments 231*a*,231*b* as a whole, including its individual components, may be made of a softer and pliable material that lends itself to being squeezed, bent, pushed, or pulled so that the fit may be adjusted on the handlebar assembly 104.

Figure 14:
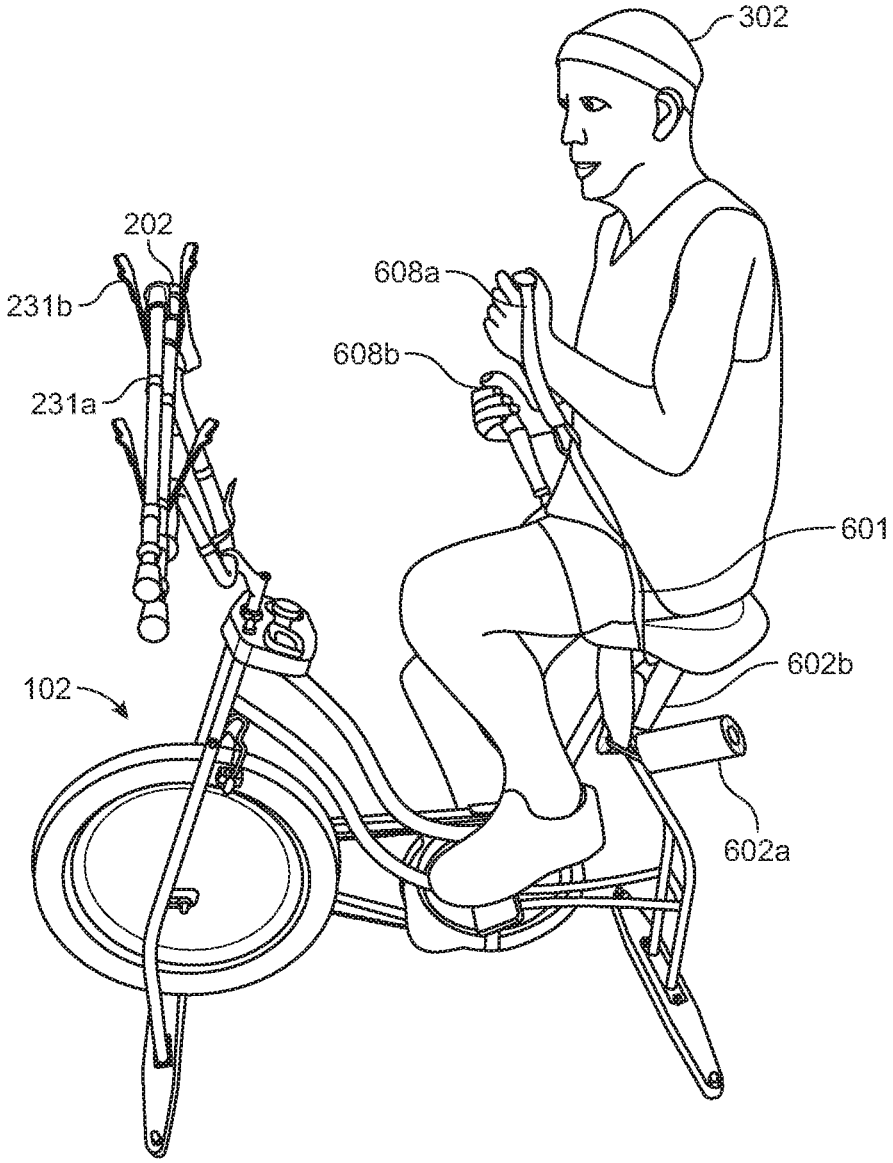
FIG. 14 is a pictorial illustration of a user utilizing the resistance band while seated and pedaling on the bicycle.

FIG. 6 further shows an example of another feature of stationary bicycle 102 in which a resistance band 601 may be stored under the seat 108 on the seat post 109 of the stationary bicycle 102 so as to be accessible to the user 302 to use for upper body workout exercises, as shown in FIG. 14 in a non-limiting embodiment. The present description includes resistance band storage mounting attachments 602*a*, 602*b* on the back side of the stationary bicycle 102 as shown in FIG. 6 in order to store the resistance band 601.

Accordingly, the resistance band 601, as shown in FIG. 6, and FIGS. 12-14, may include one or more bands 604*a*, 604*b* that connect at a connection point 610 at each end of the bands 604*a*, 604*b* to individual hand grips 608*a*, 608*b* attached to each end of the one or more bands 604*a*, 604*b* of the resistance band 601. The hand grips 608*a*, 608*b* may have a grip portion that is horizontal and a large interior cavity where the hand is intended to fit. The hand grips 608*a*, 608*b* may be inserted onto the cylinders 602*a*, 602*b* (discussed with respect to FIGS. 12-14) which may be respectively mounted over the mounting attachments 1002*a*, 1002*b* of FIGS. 10-11 as further discussed below.

FIG. 10 and FIG. 11 show another non-limiting embodiment of a mounting attachments 1002*a*, 1002*b*. The first and second mounting attachments 1002*a*,1002*b* may be used for multiple purposes. In one non-limiting embodiment, the first and second mounting attachments may be used to hold walking poles 204,206, as shown in FIG. 11 in addition to or instead of walking pole mounting attachments 231*a*, 231*b* shown in FIG. 2C-FIG. 9. In another non-limiting embodiment, the first and second mounting attachments 1002*a*, 1002*b* may be used to also hold the resistance band 601 and hand grips 608*a*, 608*b* as discussed above with respect to FIG. 6 and as discussed further below in FIGS. 12-14.

Advantageously, the first mounting attachment 1002*a*, as shown in FIG. 11, and the second mounting attachments 1002*b*, may have the same bendable, pliable properties of the first and second walking pole mounting attachments 231*a*,231*b* to allow for manipulating of the components of the first and second mounting attachments 1002*a*,1002*b* to best fit the handlebar assembly 104 and walking poles 204,206 to be placed in or stored in the mounting attachments 1002*a*,1002*b* or to hold the resistance band 601 and hand grips 608*a*, 608*b*.

As shown in FIG. 10, the second embodiment for the first, second mounting attachments 1002*a*,1002*b* may include a single angled top piece or arm 1008 that joins 1014 with a base portion 1006. The base portion 1006 may flatten out in a horizontal direction and may join with a clamping piece 1004 as shown in FIG. 10 and FIG. 11. The clamping piece 1004 may be encircled around any vertical and/or horizontal part of the structural members 120,122 of the handlebar assembly 104 on the left and right side. In a non-limiting embodiment, fasteners 1012 are used to fasten the clamping piece 1004 together and hold the clamping piece 1004 encircled around the structural members 120, 122 of the handlebar assembly 104.

As shown in FIG. 11, the walking poles 206, 204, may be laid out in a horizontal direction across the top surface of the handlebar assembly 104 and lean in against each arm 1008 of each first and second mounting attachment 1002*a*,1002*b* and may be stored against the handlebar assembly 104 in such a manner. As shown in the example in FIG. 11, the first and second mounting attachments 1002*a*, 1002*b* do not have to be attached to the same side of the handlebar assembly 104. A first mounting attachment 1002*a*,1002*b* may be attached to an interior facing side of the handlebar assembly 104 while a second mounting attachment 1002*a*, 1002*b* may be attached to an exterior facing side of the handlebar assembly 104 or vice versa. In such a manner, the mounting attachments 1002*a*, 1002*b* (or walking pole mounting attachments 231*a*, 231*b* shown in FIG. 6) can be aligned on a same interior or exterior side of the handlebar assembly 104 or may be on opposite sides and still be used to mount the respective items (e.g., walking poles 204, 206 or resistance band 601).

Figure 7:
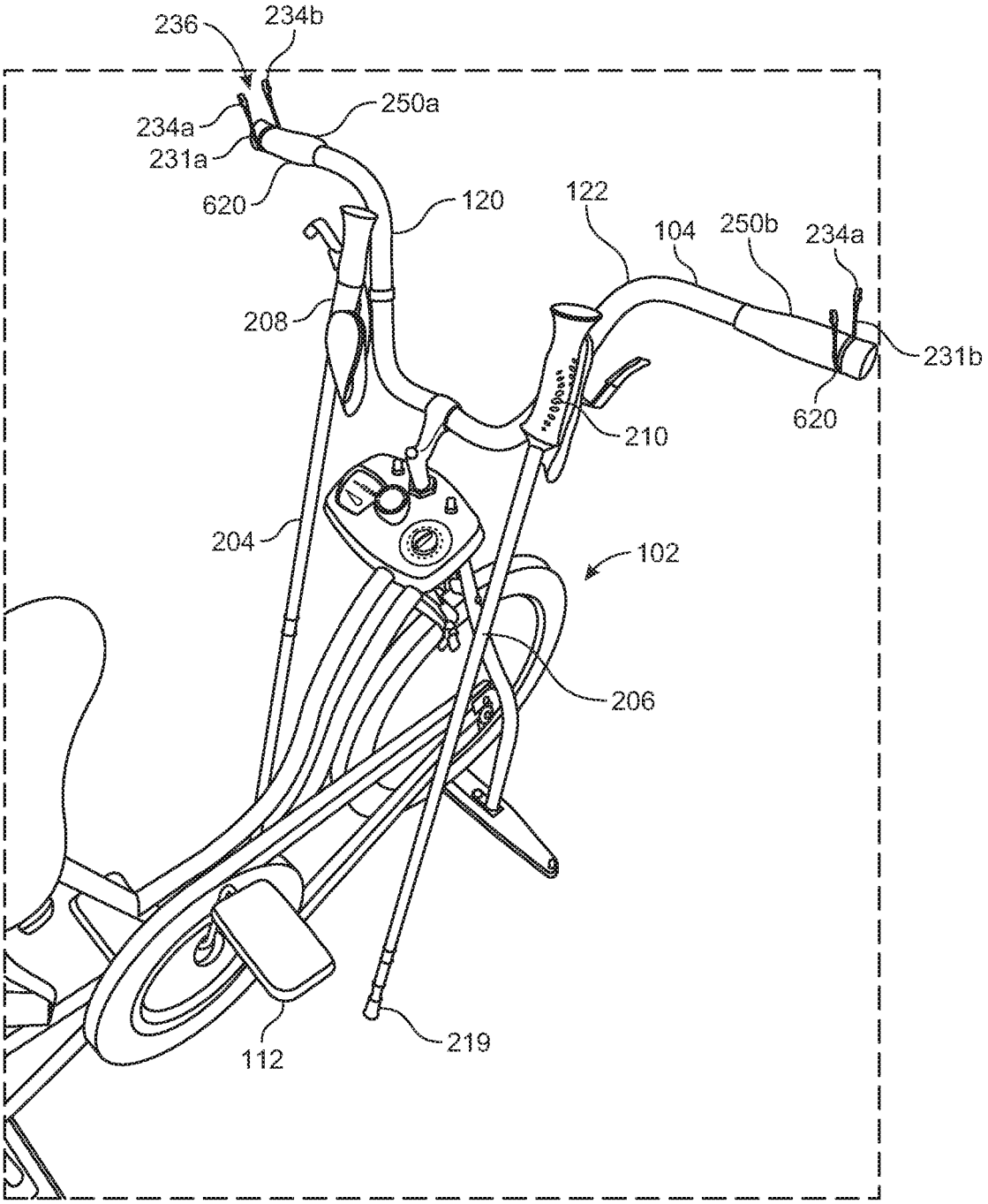
FIG. 7 is a pictorial illustration of walking poles resting on an interior portion of a handlebar of a stationary bike with the walking pole attachments shown mounted on the handlebar of the stationary bike.

With respect to FIG. 7, FIG. 7 shows the first and second walking pole mounting attachments 231*a*, 231*b* facing in an upwards direction and joined at attachment point 620 to the left and right structural members of the handlebar assembly 104. As shown in FIG. 7, the first and second walking pole mounting attachments 231*a*, 231*b* are attached to the top left and right horizontal structural members 630, 631 of the handlebar assembly 104 and are ready to receive the walking poles 204, 206 within the interior cavities 236 of the first and second walking pole mounting attachments 231*a*, 231*b* located on each left and right side of the handlebar assembly 104. As shown in FIG. 7, the walking poles 204, 206 are leaning against the interior side of the handle bar assembly 104, and may be placed this way by the user 302 temporarily for easy access prior to or after a workout, however, it is possible to store the first and second walking poles 204, 206 in a better fashion using either the first and second walking pole attachments 231*a*, 231*b* shown in FIG. 7 or the first and second mounting attachments 1002*a*,1002*b* shown in FIG. 7 as well. The first and second mounting attachments 1002*a*, 1002*b* as shown in FIG. 7 may be attached to the handlebar assembly 104 and include the same components as shown in FIGS. 10-11 and discussed above.

FIG. 8 shows the user 302 seated on the seat 108 of the stationary bicycle 102 holding the free walking poles 204, 206 on each side of the user 302. The bottom end tip 212 and rubber piece 219 of exemplary walking pole 204 are shown touching the ground surface. Accordingly, the user 302 may pedal the pedals in a forward direction as indicated by arrow A in FIG. 9 while keeping the walking poles 204, 206 to the user 302's side with the end tips 212, 214 (e.g., as shown in FIG. 2A) remaining against the ground surface. Such inclusion of the walking poles 204, 206 may provide greater support, stability, and balance to the user 302 while seated and/or pedaling on the stationary bicycle 102. Many users complain of discomfort when seated and/or pedaling on the stationary bicycle 102 for any period of time, and the inclusion of the walking poles 204, 206 may permit the user 302 to feel more comfortable and secure.

Figure 9:
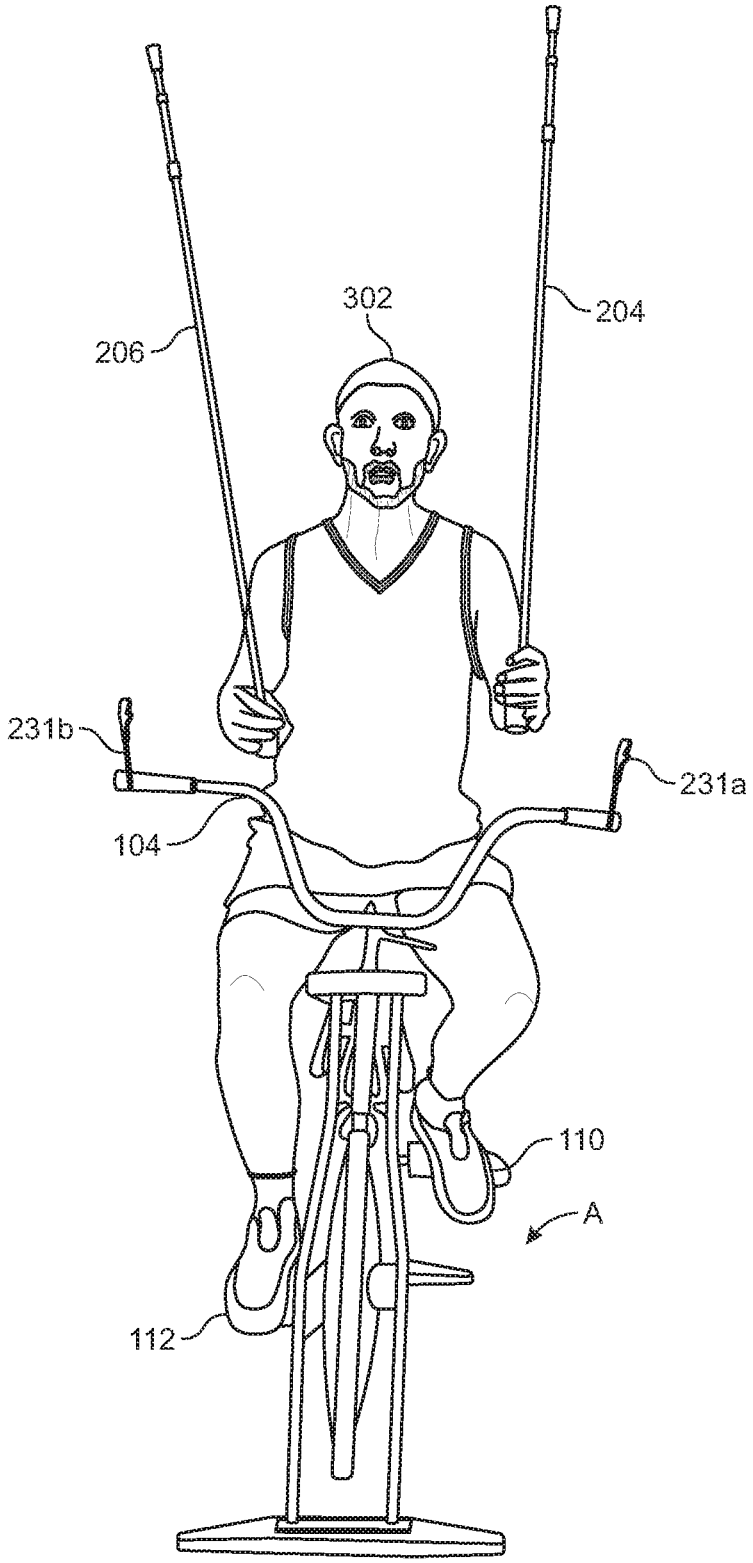
FIG. 9 is a pictorial illustration of the user on the stationary bicycle raising the walking poles in the air while pedaling on the stationary bicycle with the walking pole mounting attachments.

Advantageously, as shown in FIG. 9, the user 302 has the option to grasp the handles 208, 210 of each walking pole 204, 206 and raise the walking poles 204,206 to the sides or upwards in the air and engage in a variety of exercises as further described below. The walking poles 204, 206, in a non-limiting embodiment, are independent and free and not attached to the stationary bicycle 102. The first and second walking pole attachments 231*a*, 231*b*, as shown in FIGS. 8-9, or the mounting attachments 1002*a*, 1002*b* as shown in FIGS. 10-11, may be (removably or permanently) attached to the handlebar assembly 104 of the stationary bicycle 102 in order for the user 302 to place his or her walking poles 204, 206 in the respective storage areas of these attachments 231*a*, 231*b*, 1002*a*, 1002*b*.

Figure 12:
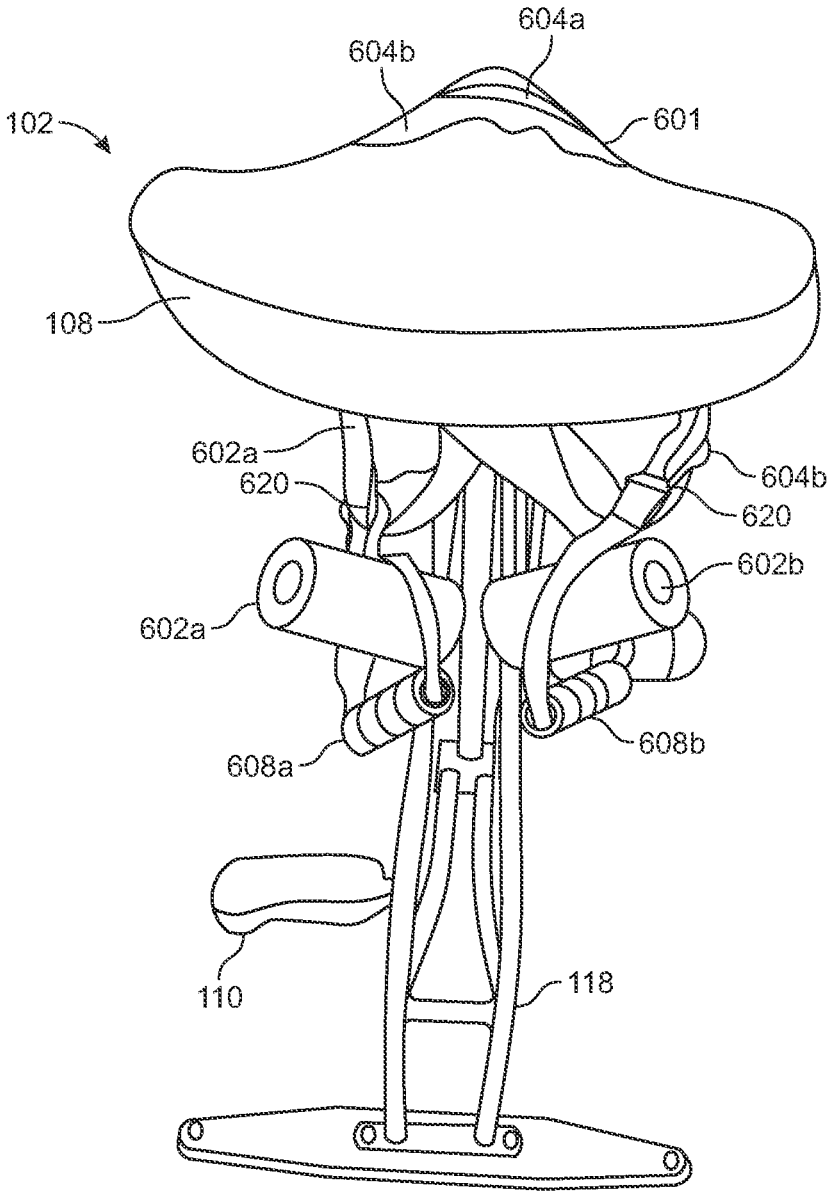
FIG. 12 is a pictorial illustration of a rear view of a stationary bicycle having the resistance band stored on the resistance band mounting attachments for the stationary bicycle.
Figure 13:
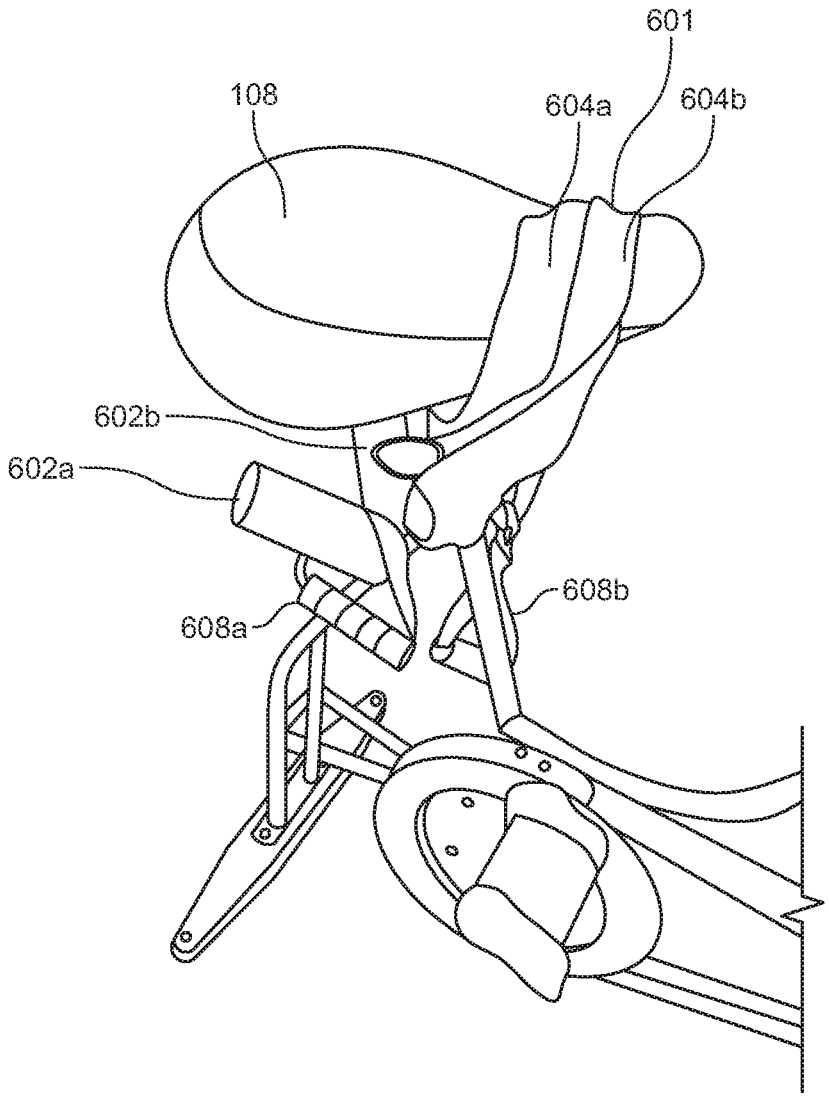
FIG. 13 is a pictorial illustration of another view of the stationary bicycle and the resistance band stored on the resistance band mounting attachments for the stationary bicycle.

Turning to FIGS. 12-14, FIGS. 12-14 provide a closer, detailed view of the resistance band 601 and mounting attachments mechanism (e.g., 602*a*, 602*b*) used to store the resistance band 601 on the stationary bicycle 102. As discussed above with respect to FIG. 6, the resistance band 601 may be an additional tool employed by the user 302 to perform upper body exercises. In a non-limiting embodiment, the resistance band 601 utilizes an elongated band section that may include one or more bands 604*a*, 604*b* that may be integrally formed together or joined together to create the appropriate length of the resistance band 601. In a non-limiting embodiment, the resistance band 601 may be wrapped around a front portion of the seat 108 of the stationary bicycle 102 as shown in FIG. 12, which may help provide more tension from the resistance band 601. In alternative embodiments, the user 302 does not have to wrap the resistance band 601 around the front portion of the seat 108 and may grip each left and right hand grip 608*a*, 608*b* of the resistance band 601 without wrapping the resistance band portions (e.g., 604*a*, 604*b*) around the front portion of the seat 108.

FIG. 12 and FIG. 13 show two cylinders 602*a*, 602*b* mounted on a back portion of the stationary bicycle 102 beneath the seat 108. In a non-limiting embodiment, the user 302 may clamp the mounting attachments 1002*a*, 1002*b* shown in FIGS. 10-11 using the clamping piece 1004 clamped to the rear structural members of the stationary bicycle 102 and/or the seat post 109. The angled arm 1008 of the mounting attachments 1002*a*, 1002*b* may angle outwards and facing to the rear of the stationary bicycle 102. The user 302 or another party may place the two cylinders 602*a*, 602*b* over the angled arms 1008 of the mounting attachments 1002*a*, 1002*b* in a non-limiting embodiment. It is noted this step is optional as the mounting attachments 1002*a*, 1002*b* may be used to store the hand grips 608*a*, 608*b* directly on each angled arm 1008 of the mounting attachments 1002*a*, 1002*b*. If the cylinders 602*a*, 602*b* are also utilized, the user 302 may place each hand grip 608*a*, 608*b* over and around each cylinder 602*a*, 602*b* and may store the resistance band 601 for quick access and use while seated on the stationary bicycle 102 seat 108 or while pedaling. FIG. 14 shows the user 302 is able to, in an exemplary exercise, hold each resistance band hand grip 608*a*, 608*b* in each hand and move each arm up and down to engage the biceps and upper arms while pedaling on the stationary bicycle 102. The pair of walking poles 202 are shown stored in their respective walking pole mounting attachments 231*a*, 231*b* and may be utilized as well during the user 302's cycling and workout.

In a non-limiting embodiment, the cylinders 602*a*, 602*b* may be made of foam or another soft material, such as plastic. Alternatively, the cylinders 602*a*, 602*b* may be made from any type of material known in the art. In the examples shown in FIG. 6 and FIGS. 12-14, the cylinders 602*a*, 602*b* are oriented at an angle away from each other and are each covering the mounting attachments 1002*a*, 1002*b* that are individually mounted to the structural members of the rear mainframe 118 of the stationary bicycle 102. Alternatively, there may be a single mounting mechanism 1002*a,b* used instead of two mounting mechanisms 1002*a*, 1002*b* and a single cylinder instead of two cylinders 602*a*, 602*b*.

As noted above, there are many benefits and advantages to using walking poles 202 on a stationary bicycle 102 as opposed to using typical weights. Weights can be too heavy and can bother a user's shoulders and back if used while pedaling on a stationary bicycle 102. A benefit of walking poles 202 is that they are usually very lightweight. Most walking poles 202 tend to weigh between 10 to 16 ounces, which is very lightweight. Traditional weights and cables may cause tension and pain in the user's shoulders and back which is counterproductive to a user when exercising and may discourage the user from exercising. In contrast, the walking poles 202 are very lightweight and do not cause pain or tension if used when pedaling on a stationary bicycle 102. Further, the walking poles 204, 206 have a narrow diameter 260 lending them to be easily held in the user 302's hands.

Further, weights do not extend to the ground surface unlike walking poles 202, whereby a user 302 would be able to support himself or herself on the stationary bicycle 102 if needed by holding the handles 208 and 210 of the walking poles 202 and leaving the bottom ends 220 of the walking poles 202 on the ground surface. Additionally, walking poles 202 lends themselves to a greater range of movement and freedom to move one's arms while on a stationary bicycle 102, as the walking poles 202 are freely detachable and are not connected to the sides of the stationary bicycle 102. The walking poles 202 can be oriented in any direction by the user 302, including up and down, side to side, left and right, rotated, angled, or any other direction as desired by the user.

Several exercises may be performed using the set of walking poles 202 in combination with the stationary bicycle 102. Some of these potential exercises are included below in the present description.

In a first exercise, the user 302 balances each walking pole 204, 206 with the end tips 212, 214 located on the ground and to the side of each pedal 110 and 112. The walking poles 204, 206 may be kept close to and parallel to the user 302's body. With one's hands grasping the top ends 216 of each pole 204, 206, the user 302 may alternate swinging the walking poles 204, 206 out to the side and back and forth. This first exercise may help the user 302 to effectively work the user 302's arms, abdomen, and back, as well as legs, if the user 302 is pedaling on the stationary bicycle 102 at any desired speed.

In a second exercise, the user 302 may balance each walking pole 204, 206 with the end tips 214, 216 positioned on the ground as well as to the sides of each pedal 110, 112. The walking poles 204, 206 may also be located close to and parallel to the user's body. With hands grasping the top ends 216 of the walking poles 204, 206, the user may alternate extending his or her arms from front to back. This second exercise may be effective in working the arms, abdomen, and back (i.e., an upper body workout) as well as the lower body using the stationary bicycle 102.

In a third exercise, the user 302 may position the tips 214, 216 of the walking poles 204 and 206 close to the pedals 110, 112. Next, the user 302 may grasp the top ends 216 of the walking poles 204 and 206 and extend both arms behind the user 302. The user 302 may keep his or her arms behind the user and swing the arms behind the user 302. This third exercise may be effective at targeting the shoulders as well as the remaining parts of the upper body and lower body.

In a fourth exercise, the user 302 may balance each walking poles 204, 206 with the tips 212, 214 of the poles 204, 206 positioned on the ground and located to the sides of each pedal 110, 112. The walking poles 204, 206 may also be located close to and parallel to the user 302's body. With the hands grasping the top ends 216 of the walking poles 204, 206, the user 302 may rotate his or her shoulders and arms. First, the user 302 may circle both arms in the same direction, such as, for example, in a clockwise direction. Next, the user 302 may circle both arms in the opposite direction, such as, for example, counterclockwise. Subsequently, the user 302 may alternate making circles in opposite directions at different intervals by moving clockwise and then counterclockwise.

In a fifth exercise, the user 302 may hold each walking pole 204, 206 in the middle of the walking pole 204, 206 with the user 302's palm down and with his or her thumb located on top of the walking pole 204, 206. Each walking pole 204, 206 should rest securely on the top of the user 302's arm in the crook of the user 302's elbow with one tip (e.g., 212 or 214) of the walking poles 202 positioned in front of the user 302 and the other top end 216 of each walking pole 204, 206 positioned behind the user 302. The starting position for the fifth exercise may include having the shoulders positioned at approximately 90-degree angles to the sides of the user 302, and with the user 302's palms facing downwards on the walking poles 204, 206. The user 302 is then able to vary the movement and has freedom to select which direction he or she chooses to move the walking poles 204, 206. For example, the user 302 may alternate swinging the user 302's forearms up and down or may alternate rotating the shoulders forward and backward. Performing this movement may internally and externally rotate the user's shoulders.

In another type of movement while engaged in the fifth exercise, the user 302 may alternate swinging his or her arms and forearms side-to-side, while abducting his or her shoulders. In another type of movement, the user 302 may cross his or her walking poles 204, 206 in front of the user's chest and swing out, then cross again as the user alternates moving one walking pole 204 above the other walking pole 206 in a continuous fashion.

In another type of movement while engaged in the fifth exercise, the user 302 may cross his or her walking poles 204, 206 in front of the user 302's chest and then extend the elbows as far back as possible. This exercise may effectively work out the chest and back of the user 302.

In a sixth exercise, the user 302 may place his or her hands in the middle of the walking poles 204, 206 with the elbows bent, and raise the user 302's arms out to the side at the same time or alternate one arm or the other up and down.

In a seventh exercise, the user 302 may grip the walking poles 204, 206 and point the pole tips 212, 214 up off the ground and pointed forward and move the arms and shoulders up and down (e.g., as shown in FIG. 9).

In an eighth exercise, the user 302 may place the walking poles 204, 206 on the user 302's shoulders with the user 302's fingers and thumbs on the handles 208, 210 of the walking poles 204, 206, and pump the arms up and down with the tips 212, 214 of the walking poles 204, 206 behind the user 302.

In a ninth exercise, the user 302 may grip the middle of the walking poles 204, 206 and raise the walking poles 204, 206 off of the ground with the tips 212, 214 of the walking poles 204, 206 pointing behind the user 302 and the user 302 may proceed to move the arms and shoulders up and down. The user may modify this exercise by bending the elbows and move the arms and shoulders up and down with the walking poles 204, 206 in the same position.

In a tenth exercise, in particular whereby the walking poles 204, 206 comprise a rubber piece 219, as shown in FIG. 2B, the user 302 may hold out the walking pole 204, 206 to each side of the user 302 and push down on the walking pole 204, 206 for a short period of time (e.g., 5-10 seconds) while pedaling or while seated on the stationary bicycle 102 without pedaling, and then release the position. The rubber piece 219 which includes an element of recoil will cause the walking poles 204, 206 to push upwards against the user 302's hands, arms, and shoulders. In this manner, this exercise provides a resistance exercise that engages this feature of the walking poles 204, 206.

Any of the exercises noted above may be performed as many sets and repetitions as the user 302 desires and may be applied with a single walking pole 204, 206 or both walking poles 204, 206.

As noted above, the use of stationary bicycle 102 while exercising provides a myriad of health benefits. The addition of the walking poles 204 and 206 allows the user to further work out the upper body without adding heavy weights that cause pain or tension to the user. Further, the walking poles 204 and 206 may assist the user in feeling more secure and stable when seated on the seat 108 of the stationary bicycle 102. The use of walking poles 204 and 206 with the stationary bicycle 102 may be particularly useful for physical therapy and rehabilitative work with patients or individuals who have suffered physical injuries, but is not limited to such an application, as the use of walking poles 204 and 206 may provide beneficial health benefits to a variety of users. Stationary bicycling on its own is popular but may be tedious and may make the user hunch over and feel tied to the stationary bicycle 102 itself. The incorporation of the walking poles 204 and 206 provides a lightweight, versatile tool to enhance the stationary bicycling experience and invigorate the user's exercise program.

Many other uses and advantages are offered by the system and method for exercising on a stationary bicycle using a set of walking poles as described above in one or more non-limiting embodiments in the present description.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A stationary bicycle, comprising:

a body comprising a main frame having a left pedal and a right pedal attached to the main frame, and a seat post connected to the main frame on a lower end and a seat connected to the seat post on an upper end of the seat post, and a handlebar assembly;

a first walking pole attachment mounted to a left structural member of a left side of the handlebar assembly of the stationary bicycle;

a second walking pole attachment mounted to a right structural member of a right side of the handlebar assembly of the stationary bicycle, wherein the first walking pole attachment and the second walking pole attachment each further comprise:

a base portion having a cavity or gap, wherein the base portion of the first walking pole attachment is attached to the left structural member of the handlebar assembly and the base portion of the second walking pole attachment is attached to the right structural member of the handlebar assembly of the stationary bicycle;

an angled left arm; and an angled right arm, wherein the angled left arm and the angled right arm angle are incline away from the base portion and define a wider cavity or gap between the angled left arm and the angled right arm, wherein there is no cover or barrier connecting a top surface of the angled left arm and a top surface of the angled right arm;

wherein the first walking pole attachment is attached to a top left horizontal member of the handlebar assembly of the stationary bicycle or to a top left vertical member of the handlebar assembly of the stationary bicycle, wherein the second walking pole attachment is attached to a top right horizontal member or a top right vertical member of the handlebar assembly of the stationary bicycle, wherein the first walking pole attachment and the second walking pole attachment are configured to hold one or more walking poles stored on the stationary bicycle, wherein the first walking pole attachment and the second walking pole attachment is attachable to face upwards or sideways, wherein when the first walking pole attachment and the second walking pole attachment face upwards, the one or more walking poles are configured to lay across a top of the handlebar assembly in a horizontal orientation, wherein when the first walking pole attachment and the second walking pole attachment face sideways, each walking pole is configured to lean or stand vertically within or against an interior portion the first and second walking pole attachments and to each side of the handlebar assembly of the stationary bicycle.

2. The stationary bicycle of claim 1, wherein the stationary bicycle further comprises:

a first resistance band mounting attachment attached to a rear portion of the seat post or other structural member of the stationary bicycle;

a second resistance band mounting attachment attached to the rear portion of the seat post or other structural member of the stationary bicycle;

wherein the first resistance band mounting attachment and the second resistance band mounting attachment further comprise:

a clamping portion configured to be fastened around the rear portion of the seat post or other structural member of the stationary bicycle; and a flat horizontal piece extending outwardly away from the clamping portion that connects with a flexible angled arm configured to angle away from the flat horizontal piece.

3. The stationary bicycle of claim 2, further comprising, a first cylinder positioned over the first resistance band mounting attachment and second cylinder positioned over the second resistance band mounting attachment.

4. The stationary bicycle of claim 1, wherein the stationary bicycle comprises a spin bicycle.

5. The stationary bicycle of claim 2, wherein a resistance band having hand grips attached to each end of the resistance band is configured to be removably stored on the first resistance band mounting attachment and the second resistance band mounting attachment.

6. The stationary bicycle of claim 1, wherein the first walking pole attachment and the second walking pole attachment are removably attachable to the handlebar assembly of the stationary bicycle and are configured to be repositioned from a first position to a second position on the handlebar assembly of the stationary bicycle.

7. The stationary bicycle of claim 1, wherein the angled left arm and the angled right arm of the first and second walking pole attachments are pliable and bendable and the wider cavity or gap between the angled left arm and the angled right arm are configured to be narrowed or widened.

8. The stationary bicycle of claim 1, wherein the first walking pole attachment and the second walking pole attachment comprise:

a clamping portion configured to be fastened to a structural member of the handlebar assembly of the stationary bicycle, wherein the clamping portion of the first walking pole attachment and the clamping portion of the second walking pole attachment is attached to the left structural member of the handlebar assembly and the right structural member of the handlebar assembly, respectively, of the stationary bicycle; and a flat horizontal piece extending outwardly away from the clamping portion that connects with a flexible angled arm configured to angle away from the flat horizontal piece.

9. A method for exercising with a pair of walking poles, comprising:

positioning a user on a seat of a stationary bicycle;

attaching a first walking pole attachment to a left structural member of a left side of a handlebar assembly of the stationary bicycle;

grasping a first walking pole and a second walking pole of the pair of walking poles, wherein the first walking pole and the second walking pole of the pair of walking poles each comprises an elongated body having a slim profile and a narrow diameter, and wherein the first walking pole and the second walking pole are freely detachable and are not coupled to the stationary bicycle or to a ground surface during the exercising; and pedaling a set of pedals of the stationary bicycles while selectively performing exercises that benefit an upper body and an upper torso of the user using the pair of walking poles, wherein the first walking pole and the second walking pole each weigh no more than 16 ounces, and wherein the first walking pole and the second walking pole are each long enough to touch the ground surface when seated on the stationary bicycle.

10. The method of claim 9, wherein the narrow diameter of each pole is no wider than 2 inches wide.

11. The method of claim 9, further comprising:

attaching a second walking pole attachment mounted to a right structural member of a right side of the handlebar assembly of the stationary bicycle, wherein the first walking pole attachment is attached to a top left horizontal member of the handlebar assembly of the stationary bicycle or to a top left vertical member of the handlebar assembly of the stationary bicycle, wherein the second walking pole attachment is attached to a top right horizontal member or a top right vertical member of the handlebar assembly of the stationary bicycle, wherein the first walking pole attachment and the second walking pole attachment are configured to hold one or more walking poles stored on the stationary bicycle for use while exercising on the stationary bicycle with the first or second walking poles, wherein the first walking pole attachment and the second walking pole attachment is attachable to face upwards or sideways, wherein when the first walking pole attachment and the second walking pole attachment face upwards, the one or more walking poles are configured to lay across a top of the handlebar assembly in a horizontal orientation, and wherein when the first walking pole attachment and the second walking pole attachment face sideways, each walking pole of the one or more walking poles is configured to extend vertically against an interior portion of the first and second walking pole attachments and to each side of the handlebar assembly of the stationary bicycle.

12. The method of claim 9, wherein the stationary bicycle comprises a spin bicycle.

13. The method of claim 9, further comprising, alternating raising the pair of walking poles from the ground surface in an upward motion on a left or right side of the user on the stationary bicycle.

14. The method of claim 9, further comprising:

pedaling on the stationary bicycle while holding the first walking pole and the second walking pole of the pair of walking poles; and holding the first walking pole and the second walking pole for balance while pedaling on the stationary bicycle, wherein a bottom end tip of the first walking pole and a bottom end tip of the right walking pole is touching the ground surface.

15. The method of claim 9, further comprising, using one pole of the pair of walking poles to exercise shoulders or back of the user while pedaling on the stationary bicycle.

16. The method of claim 9, further comprising, performing a first resistance exercise further comprising:

pushing down on each pole of the pair of walking poles while pedaling and holding said pushed down position for a short period of time.

17. The method of claim 9, further comprising, using the pair of walking poles to incorporate light to moderate intensity in a workout.

18. The method of claim 9, further comprising, using the pair of walking poles to integrate a greater range of movement and flexibility in the upper body and the upper torso.

* * * * *